US010096900B2

(12) United States Patent
Dupuy et al.

(10) Patent No.: US 10,096,900 B2
(45) Date of Patent: Oct. 9, 2018

(54) MULTI-BAND COMMUNICATION SYSTEM WITH ISOLATION AND IMPEDANCE MATCHING PROVISION

(71) Applicant: Ethertronics, Inc., San Diego, CA (US)

(72) Inventors: Alexandre Dupuy, San Diego, CA (US); Laurent Desclos, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 15/354,736

(22) Filed: Nov. 17, 2016

(65) Prior Publication Data

US 2017/0141467 A1 May 18, 2017

Related U.S. Application Data

(63) Continuation of application No. 13/854,495, filed on Apr. 1, 2013, now abandoned, which is a continuation-in-part of application No. 13/717,519, filed on Dec. 17, 2012, now Pat. No. 9,263,793.

(60) Provisional application No. 61/636,558, filed on Apr. 20, 2012, provisional application No. 61/649,369, filed on May 21, 2012.

(51) Int. Cl.

| | |
|---|---|
| ***H01Q 5/335*** | (2015.01) |
| ***H01Q 5/378*** | (2015.01) |
| ***H01Q 21/30*** | (2006.01) |

(52) U.S. Cl.

CPC ..... *H01Q 5/335* (2015.01); *H01Q 5/378* (2015.01); *H01Q 21/30* (2013.01)

(58) Field of Classification Search

CPC ..... H01Q 5/0041; H01Q 5/0048

See application file for complete search history.

(56) References Cited

U.S. PATENT DOCUMENTS

| | | | | |
|---|---|---|---|---|
| 2008/0111748 | A1 | 5/2008 | Dunn | |
| 2011/0002080 | A1 | 1/2011 | Ranta | |
| 2013/0154897 | A1* | 6/2013 | Sorensen | H01Q 7/005 343/861 |

OTHER PUBLICATIONS

Agilent Technologies, "LTE-Advance Physical Layer Design and Test Challenges: Carrier Aggregation" (2012).

Ahmad Chamseddine et al.; "CMOS Silicon-on-Sapphire RF TunableMatching Networks"; EURASIP Journal on Wireless Communications and Networking vol. 20006, Article ID 86531, pp. 1-11.

Dupuy, A.; Leong, K.M.K.H.; Itoh, T.; "Class—F power amplifier using a multi-frequency composite right/left—handed transmission line harmonic tuner"; Microwave Symposium Digest, 2005 IEEE MTT-S International; Jun. 12-17, 2005.

(Continued)

*Primary Examiner* — Robert Karacsony

(74) *Attorney, Agent, or Firm* — Dority & Manning, P.A.

(57) ABSTRACT

A communication system is provided, including one or more antennas coupled to multiple RF paths, one or more matching blocks, each block including multiple matching networks, a look-up table including characterization data according to frequency bands and conditions, and a controller configured to control the multiple matching networks by referring to the look-up table to provide optimum impedance for a frequency band selected and a condition detected during a time interval. The matching block may further include switches and adjustment circuits.

9 Claims, 21 Drawing Sheets

(56) References Cited

OTHER PUBLICATIONS

IWPC; "Tuning Technology: Key Element to Lower Operating Costs While Improving Wireless Network Performance"; IWPC Tunable Components and Architectures Working Group; white paper Feb. 8, 2011.
Peregrine Semiconductor; "DTC Theory of Operation"; Document No. 72-0051-01 (2011).
Chao Lu et. al.; "Development of Multiband Phase Shifters in 180-nm RF CMOS Technology With Active Loss Compensation"; IEEE Transactions on Microwave Theory and Techniques, vol. 54, No. 1, Jan. 2006.
Dongjiang Qiao et al.; "Antenna Impedance Mismatch Measurement and Correction for Adaptive CDMA Transceivers"; Microwave Sumposium Digest, 2005 IEEE MTT-S International; Jun. 12-17, 2005.
WiSpry; "Introduction and Theoretical Background to Tunable Impedance Matching".

* cited by examiner

| Condition | Band | C1 (pF) | C2 (pF) | L1 (nH) | L2 (nH) | ..... |
|---|---|---|---|---|---|---|
| 1 | 1 | 0.1 | 0.5 | 0.5 | 1 | |
| 1 | 2 | 1 | 3 | 2 | 6 | |
| 1 | 3 | 2 | 5 | 10 | 15 | |
| 1 | 4 | 10 | 30 | 5 | 3 | |
| 2 | 1 | 3 | 0.1 | 3 | 7 | |
| 2 | 2 | 5 | 2 | 10 | 4 | |
| 2 | 3 | 15 | 20 | 20 | 9 | |
| 2 | 4 | 1 | 3 | 5 | 20 | |
| 3 | 1 | 6 | 5 | 0 | 30 | |
| 3 | 2 | 0 | 8 | 0 | 8 | |
| 3 | 3 | 8 | 0.5 | 15 | 0 | |
| 3 | 4 | 12 | 0 | 3 | 2 | |
| ⋮ | | | | | | ⋱ |

FIG. 5

| Band | Tx (MHz) | Rx (MHz) | Mode/Category | | |
|---|---|---|---|---|---|
| 1 | 1920-1980 | 2110-2170 | | | LTE High |
| 2 | 1850-1910 | 1930-1990 | GSM | PCS | |
| 3 | 1710-1785 | 1805-1880 | GSM | DCS | |
| 4 | 1710-1755 | 2110-2155 | | | |
| 5 | 824-850 | 870-895 | GSM | | |
| 8 | 880-915 | 925-960 | GSM | | |
| 12 | 698-716 | 728-746 | | | LTE Low |
| 13 | 777-787 | 746-756 | | | |
| 14 | 788-798 | 746-768 | | | |
| 17 | 704-716 | 734-746 | | | |
| 20 | 791-821 | 832-862 | | | |

FIG. 8

MULTI-BAND COMMUNICATION SYSTEM WITH ISOLATION AND IMPEDANCE MATCHING PROVISION

CROSS REFERENCE TO RELATED APPLICATIONS

This application is a continuation (CON) of U.S. Ser. No. 13/854,495, filed Apr. 1, 2013;

which is a continuation-in-part (CIP) of U.S. patent application Ser. No. 13/717,519, entitled "MULTI-BAND COMMUNICATION SYSTEM WITH ISOLATION AND IMPEDANCE MATCHING PROVISION," filed on Dec. 17, 2012;

which claims priority with U.S. Provisional Application Ser. No. 61/636,558, entitled "MULTI-BAND COMMUNICATION SYSTEM WITH ISOLATION AND IMPEDANCE MATCHING PROVISION," filed on Apr. 20, 2012; and further claims priority with U.S. Provisional Application No. 61/649,369, entitled "MULTI-BAND COMMUNICATION SYSTEM WITH ISOLATION AND IMPEDANCE MATCHING PROVISION II," filed on May 21, 2012.

BACKGROUND OF THE INVENTION

Frequency bands and modes associated with various protocols are specified per industry standards for cell phone and mobile device applications, WiFi applications, WiMax applications and other wireless communication applications, and the number of specified bands and modes is increasing as the demand pushes. Examples of the frequency bands and modes for cell phone and mobile device applications are: the cellular band (824-960 MHz) which includes two bands, CDMA (824-894 MHz) and GSM (880-960 MHz) bands; and the PCS/DCS/WCDMA1 band (1710-2170 MHz) which includes three bands, DCS (1710-1880 MHz), PCS (1850-1990 MHz) and AWS/WCDMA1 (1920-2170 MHz) bands. Examples or uplink for transmit (Tx) signals include the frequency ranges of DCS (1710-1785 MHz) and PCS (1850-1910 MHz). Examples for downlink for receive (Rx) signals include the frequency ranges of DCS (1805-1880 MHz) and PCS (1930-1990 MHz). Examples of frequency bands for WiFi applications include two bands: one ranging from 2.4 to 2.48 GHz, and the other ranging from 5.15 GHz to 5.835 GHz. The frequency bands for WiMax applications involve three bands: 2.3-2.4 GHz, 2.5-2.7 GHZ, and 3.5-3.8 GHz. Use of frequency bands and modes is regulated worldwide and varies from country to country. For example, for uplink, Japan uses CDMA (915-925 MHz) and South Korea uses CDMA (1750-1780 MHz). Here, "modes" refer to WiFi, WiMax, LTE, WCDMA, CDMA, CDMA2000, GSM, DCS, PCS and so on; and "bands" or "frequency bands" refer to frequency ranges (700-900 MHz), (1.7-2 GHz), (2.4-2.6 GHz), (4.8-5 GHz), and so on. Laptops, tablets, personal digital assistants, cellular phones, smart phones and other mobile devices include a communication system which may be designed to have paths or chains to process signals in multiple modes and bands.

As new generations of wireless communication devices become smaller and packed with more multi-mode multi-band functions, designing new types of antennas and associated air interface circuits is becoming increasingly important. In particular, a communication device with an air interface tends to be affected by use conditions such as the presence of a human hand, a head, a metal object or other interference-causing objects placed in the vicinity of an antenna, resulting in impedance mismatch and frequency shift at the antenna terminal. Accordingly, an impedance matching solution is required in the device to optimize efficiency, linearity and various other performance metrics by adjusting impedances over multiple bands and modes using as little real estate as possible.

BRIEF DESCRIPTION OF THE DRAWINGS

FIG. 5 illustrates an example of a look-up table.

FIG. 8 is a table showing the modes and frequency bands that are processed by using the communication system of FIG. 7.

DETAILED DESCRIPTION

In view of the isolation and impedance matching considerations for a multi-mode multi-band communication system having multiple paths, this document provides implementations and examples of communication systems configured to provide enhanced isolation and impedance matching. Such a system may be suited for supporting carrier aggregation for next-generation wireless protocols and technologies. Details are described below with reference to the corresponding figures.

Figure 1:
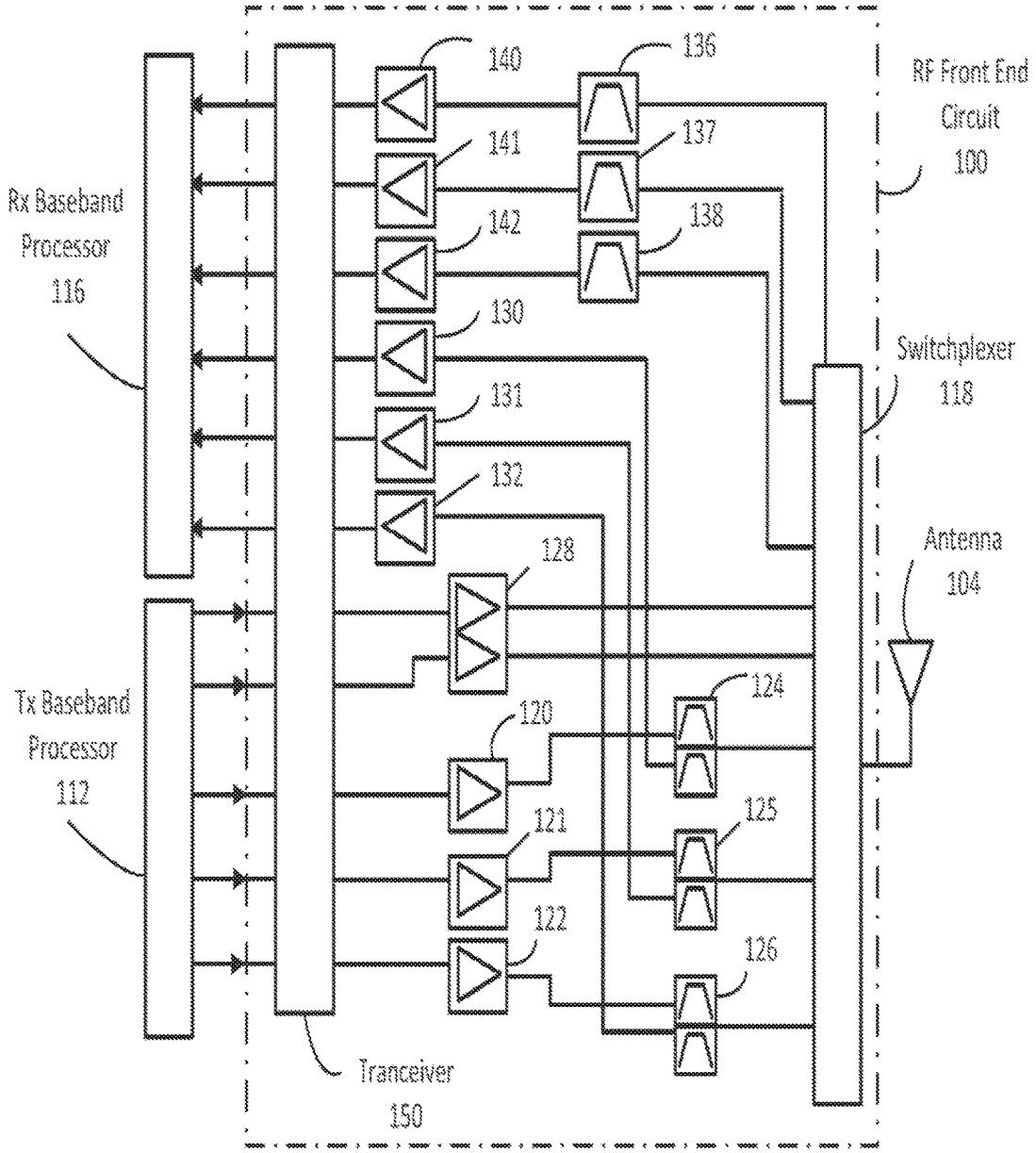
FIG. 1 (Prior Art)
FIG. 1 is a block diagram illustrating an example of an architecture of a conventional communication system.

FIG. 1 is a block diagram illustrating an example of an architecture of a conventional communication system including an RF front end circuit 100 coupled to an antenna 104, a Tx baseband processor 112 and an Rx baseband processor 116. These baseband processors may be fabricated on a same chip. Tx signals to be transmitted out from the antenna 104 are inputted from the Tx baseband processor 112 into the RF front end circuit 100, and Rx signals received by the antenna 104 are outputted into the Rx baseband processor 116 from the RF front end circuit 100. These signals are processed by various components and modules configured in the RE front end circuit 100. In this example, the Tx signals are in five mode/band combinations, e.g., DCS (1710-1785 MHz), PCS (1850-1910 MHz), etc., and are processed through respective Tx paths in the RF front end circuit 100. Also in this example, the Rx signals are in six mode/band combinations, e.g., DCS (1805-1880 MHz), PCS (1930-1990 MHz), etc., and are processed through respective Rx paths in the RF front end circuit 100. Many communication systems are designed based on a duplexing scheme such as time division duplex (TDD), frequency division duplex (FDD) or a combination of both, and may use a switch, a diplexer or other components to separate the signals between Tx and Rx paths. This example in FIG. 1 includes a switch such as a switchplexer (single-pole-multiple-throw switch) 118 to switch between Tx and Rx paths as well as among paths for different mode/band combinations. Power amplifiers (PAs) are used in the Tx paths to amplify the Tx signals. Low noise amplifiers (LNAs) are used in the Rx paths to amplify the Rx signals while adding as little noise and distortion as possible to increase sensitivity and sensibility. Each PA or LNA in this example is adapted to operate for a single mode/band combination. The Tx signals having three different mode/band combinations that enter from the lower three ports of the Tx baseband processor 112 and go through a transceiver 150 are amplified by PAs 120, 121, and 122, respectively, and filtered through duplexers 124, 125, 126, respectively. On the other hand, the Rx signals in the corresponding three modes are filtered through the duplexers 124, 125 and 126, respectively, sent to LNAs 130, 131 and 132, respectively, then to the transceiver 150, and outputted to the lower three ports of the Rx base station processor 116, respectively. Additionally, this example in FIG. 1 shows that the PAs to amplify the Tx signals, coming out of the upper two ports of the Tx baseband processor 112 and then through the transceiver 150, are integrated on a same chip 128, and that the amplified Tx signals in the two paths reach the switchplexer 118 without a duplexer. A duplexer may be omitted in some applications as in these two paths. A filter may optionally be added at the output side of the PA to reduce harmonics, for example. Also shown in the example in FIG. 1 are filters 136, 137 and 138, which are used for the Rx signals in three different mode/band combinations, respectively, and these Rx signals are sent to LNAs 140, 141 and 142, respectively, then to the transceiver 150, and outputted to the upper three ports of the Rx baseband processor 116, respectively. In some applications a band pass filter can be included at the output of the LNA to remove unwanted noise power or spurs generated by the LNA, which might affect the down-converter in the transceiver 150 that follows. Similarly in the Tx path, it possible to configure an architecture with a band pass filter at the input of the PA in order to filter out the unwanted signals produced by the mixer in the transceiver 150.

As seen in the above example of a conventional architecture of FIG. 1, a communication system can generally be designed to support one or more modes and frequency bands. A single antenna is typically used to cover both Tx and Rx bands in a conventional muti-band system as in this example. A single-pole-multiple-throw switch, such as the switchplexer 118, is employed to engage one of the multiple paths depending on the band of the signal from or to the single antenna 104. Such a switch can provide a certain level of isolation among the multiple paths. However, the use of semiconductor switches for the signal routing can pose cost disadvantages, for example, in some applications that require expensive GaAs FETs. Furthermore, in some systems, power leak from one path to another can still occur even when such a switch is used. With the advent of advanced filter technologies such as Bulk Acoustic Wave (BAW), Surface Acoustic Wave (SAW) or Film Bulk Acoustic Resonator (FBAR) filter technology, the band path filter technology tends to increase the maximum ratings for input power. Thus, these filters can provide resilience to the power leak as well as steep and high rejection characteristics. However, these filters are often fabricated based on a costly platform, for example, Low Temperature Co-fired Ceramic (LTCC) technology. Furthermore, the steep and high rejection characteristics of these filters often leads to high insertion loss, giving rise to degraded power transmission in the pass band.

In addition to isolation considerations, the practical implementation of RF communication systems involves matching of different impedances of coupled blocks to achieve a proper transfer of signal and power. Such implementation tasks include the matching from an antenna to an LNA input, as well as from a PA output to an antenna. The 50Ω matching is employed for a typical communication system, whereby matching networks may be provided inside or outside the LNA, as well as inside or outside the PA. Note, however, that LNAs or PAs generally have low efficiency in the proximity of 50Ω: in today's RF amplifier technologies, LNAs generally have optimum efficiency at high impedance, e.g., ~200Ω, and PAs generally have optimum efficiency at low impedance, e.g. ~5Ω.

To alleviate the isolation and impedance matching problems as above, a multi-feed antenna, which can be coupled to two or more signal paths, may be used to provide isolation among the paths by providing the physical separation of the paths as well as improving impedance matching for each path. Examples and implementations of multi-feed antennas are described in commonly owned U.S. application Ser. No. 13/548,211, entitled "MULTI-FEED ANTENNA FOR PATH OPTIMIZATION," filed on Jul. 13, 2012; the contents of which are hereby incorporated by reference. In particular, the isolation of Tx and Rx paths with individual impedance matching is considered based on the multi-feed antenna in commonly owned U.S. application Ser. No. 13/608,883, entitled "COMMUNICATION SYSTEMS WITH ENHANCED ISOLATION PROVISION AND OPTIMIZED IMPEDANCE MATCHING," filed on Sep. 10, 2012; the contents of which are hereby incorporated by reference.

Figure 2:
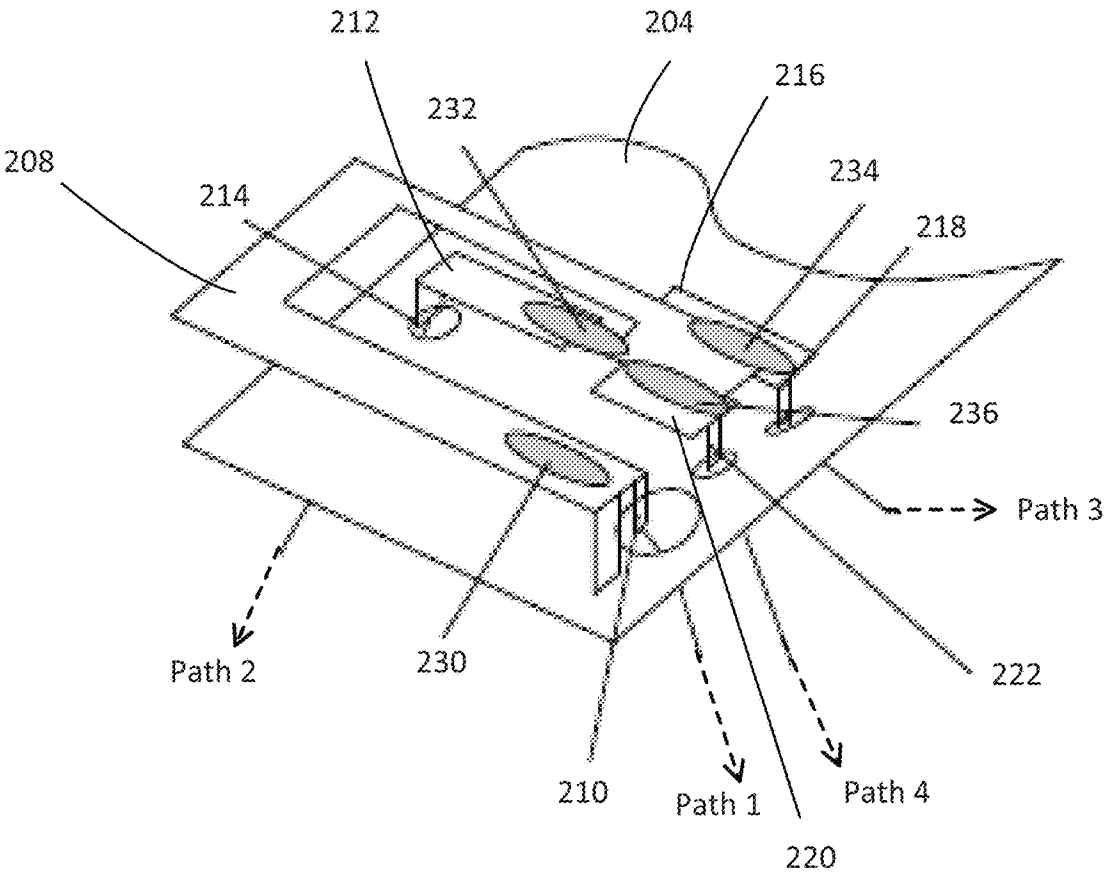
FIG. 2 illustrates an example of an antenna structure used to configure a multi-feed antenna.

FIG. 2 illustrates an example of an antenna structure used to configure the multi-feed antenna. The antenna structure includes a ground plane 204, an isolated magnetic dipole (MD) radiating element 208 providing a first feed port 210, a second element 212 providing a second feed port 214, a third element 216 providing a third feed port 218, and a fourth element 220 providing a fourth feed port 222. These elements 208, 212, 216 and 220 are coupled to the ground plane 204. The feed ports 210, 214, 218 and 222 are configured to couple to multiple paths, i.e., path 1, path 2, path 3 and path 4, respectively, corresponding to four different mode/band combinations in the communication system, thereby providing physical separation of the paths. The antenna structure in this example further includes active components 230, 232, 234 and 236, coupled to the feed ports 210, 214, 218 and 222, respectively, allowing for frequency response optimization for each band carried by the corresponding path. In place of or in addition to the active components 230, 232, 234 and 236, an antenna tuning module may be coupled to each feed port. The antenna tuning module may include active as well as passive components that can be configured to optimize the frequency response and/or the impedance matching for each path. Thus, the isolation may be further improved due to the impedance matching individually configured for the separate paths, in addition to the isolation provided by the physical separation of the paths realized by the multiple feeds of the antenna structure.

A conventional communication system with a passive antenna generally is not capable of readjusting its functionality to recover optimum performances when a change in impedance detunes the antenna, causing a change in system load and a shift in frequency. A tunable antenna can be used to adjust the perturbed properties by controlling the beam, frequency response, impedance and other antenna characteristics so as to recover the optimum performances. See, for example, U.S. Pat. No. 6,900,773, No. 7,830,320 and No. 7,911,402, which describe examples of active tunable antennas. Additionally or alternatively, a tunable matching network can he used to provide proper impedance dynamically according to the use condition and/or the environment during a time interval based on information on the mismatch. Commonly owned U.S. patent application Ser. No. 13/675,981, entitled "TUNABLE MATCHING NETWORK FOR ANTENNA SYSTEMS," filed on Nov. 13, 2012, describes a flexible and tailored matching scheme capable of maintaining the optimum system performances as frequency bands, conditions, environments and surroundings vary with time; the contents of which are hereby incorporated by reference. In other words, this matching scheme provides matching network configurations having impedance values tailored for individual scenarios. This scheme is fundamentally different from a conventional scheme of providing beforehand impedance values corresponding to discrete points in the Smith chart based on combinations of fixed capacitance values, which may be unnecessarily excessive, wasting real estate, and/or missing optimum impedance values. Specifically, in the conventional fixed-capacitance scheme, termed a binary scheme herein, the capacitors and switches are binary-weighted from a least significant bit (LSB) to a most significant bit (MSB). On the other hand, in the tailored scheme, impedance values are optimized in advance according to frequency bands and detectable conditions including use conditions and environments.

Figure 3:
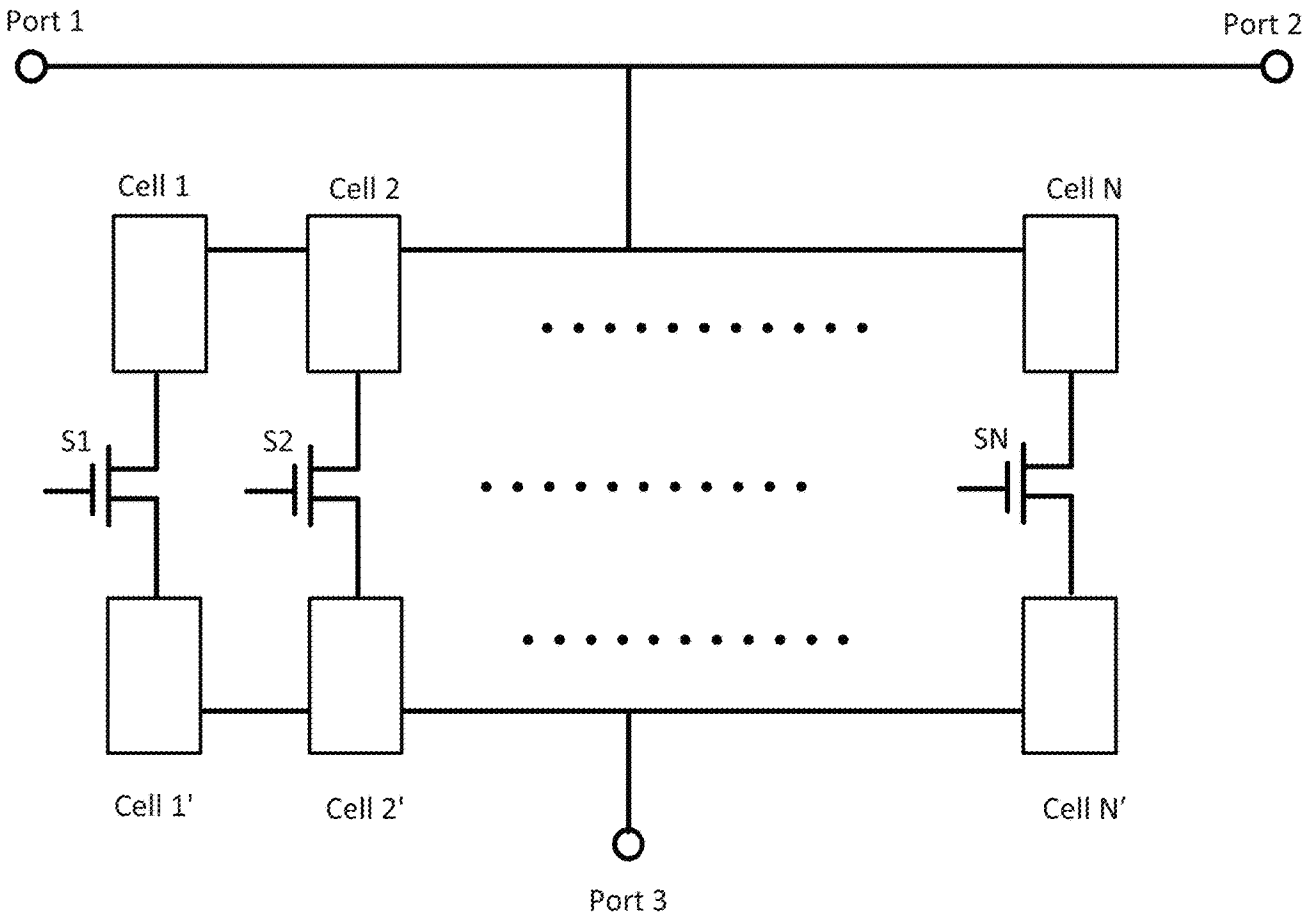
FIG. 3 illustrates an example of a configuration of a tunable matching network according to a tailored matching scheme.

FIG. 3 illustrates an example of a configuration of the tunable matching network according to the tailored matching scheme. This configuration includes multiple switches S1, S2 . . . and SN; and component blocks cell 1, cell 2 . . . and cell N, and cell 1', cell 2' . . . and cell N'. Each switch is coupled to a first cell on one side and a second cell on the other side in series. The branches, each branch having a switch, a first cell on one side of the switch and the second cell on the other side of the switch, are coupled together in parallel. A simplified configuration is possible by including only the first set of cells, cell 1, cell 2 . . . and cell N, each coupled to a switch. Other configuration examples of the tunable matching network are described in detail in commonly owned U.S. patent application Ser. No. 13/675,981, entitled "TUNABLE MATCHING NETWORK FOR ANTENNA SYSTEMS," filed on Nov. 13, 2012. One end of the paralleled branches is coupled to the path coupled to port 1 and port 2; and the other end of the paralleled branches is coupled to port 3. This configuration may provide convenience and ease in designing a shunt circuit by coupling ports 1 and 2 to the RF path, with an option of coupling port 3 to another circuit, module or component in the system, shorting it to ground or keeping it open. This configuration can also be used as a series circuit by coupling port 1 (or 2) and port 3 to the RF path, with an option of coupling port 2 (or 1) to another circuit, module or component in the system, shorting it to ground or keeping it open. Each cell may include one or more components such as capacitors and/or inductors. The gate (or base) terminals of the switches S1, S2 . . . and SN are controlled by a controller. By turning on one of the switches, this tunable matching network can provide N possible impedance states, which are determined by the combinations of cell 1+cell 1', cell 2+cell 2' . . . and cell +N cell N'. Furthermore, additional impedance states can be provided by turning on two or more switches. Thus, the tuning matching network is capable of providing customized impedance states that are predetermined based on frequency bands and expected conditions, environments and others.

Figure 4:
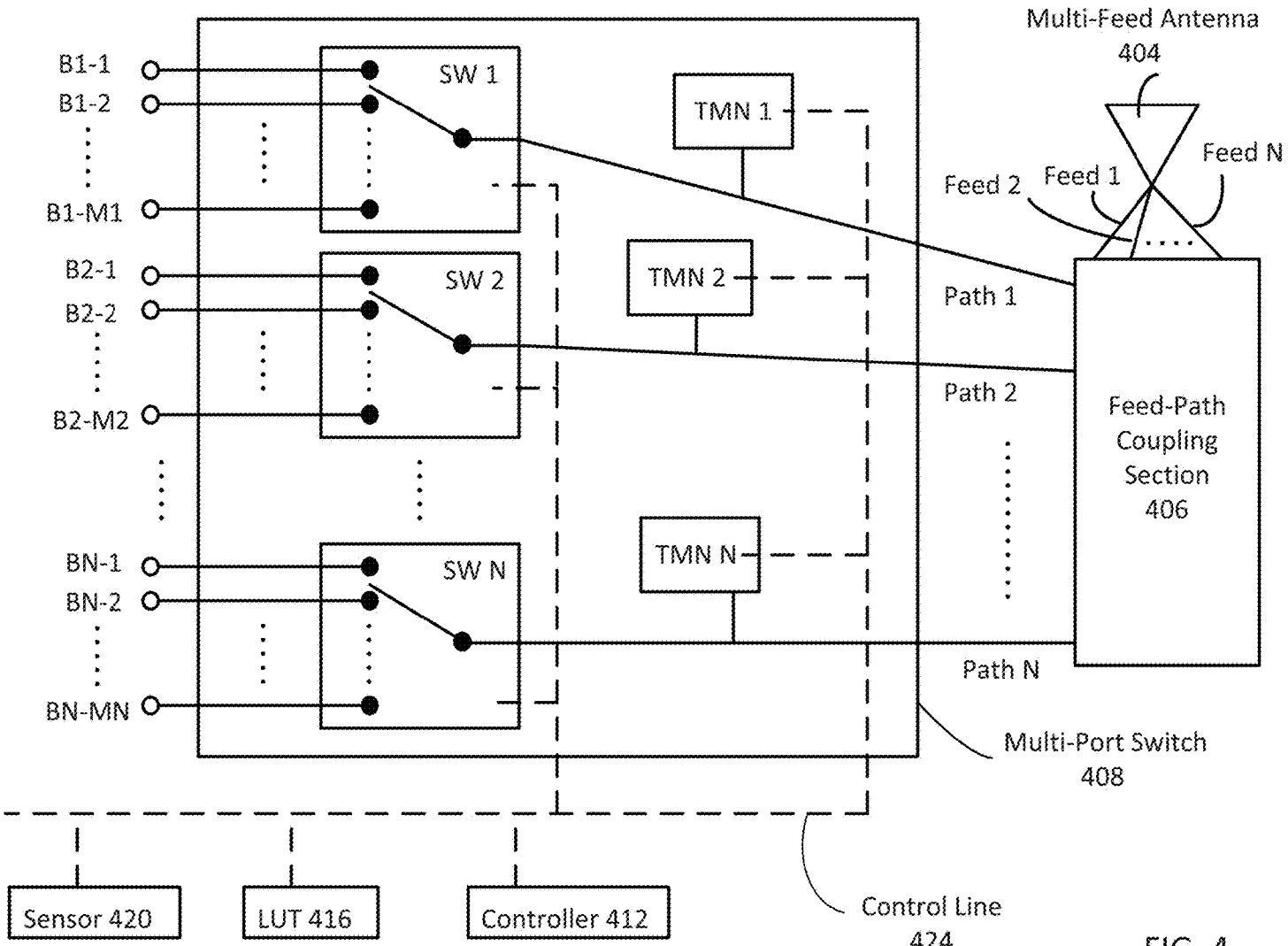
FIG. 4 illustrates an example of a configuration of a communication system, the configuration incorporating a multi-feed antenna and tunable matching networks.

Referring back to FIG. 1, the conventional system has the switchplexer 118, which is a single-pole-multiple-throw switch, coupled to a single path from the antenna 104 on one side and multiple RF paths on the other side to process signals respectively in multiple bands. To improve isolation and impedance matching of a system, a multi-feed antenna such as shown in FIG. 2 and a tunable matching network such as shown in FIG. 3 can be utilized. FIG. 4 illustrates an example of a configuration of a communication system, the configuration incorporating a multi-feed antenna and tunable matching networks. This system includes a multi-feed antenna 404, which is a single antenna for transmit (Tx) and receive (Rx) in this example, and a multi-port switch 408. Examples of multi-feed antennas are described in commonly owned U.S. application Ser. No. 13/548,211, entitled "MULTI-FEED ANTENNA FOR PATH OPTIMIZATION," filed on Jul. 13, 2012, such as illustrated in FIG. 2. However, antennas with any type of multi-feed techniques and configurations can be used in the present system. For example, a power combiner/divider may be used to provide multiple feeds. The multi-feed antenna 404 is configured to couple to path 1, path 2 . . . and path N through a feed-path coupling section 406, where N is the number of feeds of the multi-feed antenna 404. The feed-path coupling section 406 is configured to couple the antenna feed 1, feed 2 . . . and feed N to the path 1, path 2 . . . and path N, respectively, in a capacitive way, an inductive way, a combination of both or other suitable methods. The path 1 is configured to support RF signals in a first group of bands, labeled B1-1, B1-2 . . . and B1-M1, where this first group includes M1-number of bands; the path 2 is configured to support RF signals in a second group of hands, labeled B2-1, B2-2 . . . and B2-M2, where this second group includes M2-number of bands; . . . ; and the path N is configured to support RF signals in a N-th group of bands, labeled BN-1, BN-2 . . . and BN-MN, where this N-th group includes MN-number of bands. The multi-port switch 408 is configured to couple to multiple paths, labeled path 1, path 2 . . . and path N, from the multi-feed antenna 404 on one side and another multiple paths on the other side to process signals respectively in multiple bands. The multi-port switch 408 includes multiple single-pole-multiple-throw switches, labeled SW 1, SW 2 . . . and SW N, corresponding to the first group of hands, the second group of bands . . . and the N-th group of bands, respectively. Each of the single-pole-multiple-throw switches is used to engage one of the paths corresponding to one of the bands in the group to process the signal in the particular band. The multi-port switch 408 further includes multiple tunable matching networks, labeled TMN 1, TMN 2 . . . and TMN N, coupled to the path 1, path 2 . . . and path N, respectively. Each of the tunable matching networks is used to dynamically provide optimum impedance for the bands in the group and the condition detected during each time interval. A configuration example of the tunable matching network is provided in FIG. 3.

A controller 412, a look-up table (LUT) 416 and a sensor 420 are coupled to each other through a control line 424, enabling the controller 412 to adjust the tunable matching networks, TMN 1, TMN 2 . . . and TMN N, based on input information. The controller 412 may be further configured to control the single-pole-multiple-throw switches, SW 1, SW 2 . . . and SW N, to engage the paths corresponding to the bands to be processed, respectively. The sensor 420 may include one or more sensors such as a proximity sensor, a motion sensor, a light sensor, a pressure sensor or other types of sensors, to detect the use condition and/or the environment and send the detected information to the controller 412. The information on the selected frequency band may be sent from a CPU or an application CPU in the system to the controller 412. The controller 412 is configured to include an algorithm to control each of the tunable matching networks, TMN 1, TMN 2 . . . and TMN N, to dynamically adjust the impedance according to the frequency band selected and the condition/environment detected during a time interval. The controller 412 may be located anywhere in the communication system, and may be integrated with the antenna 404, the multi-port switch 408, or other parts in the communication system. The LUT 416 tabulates measured and/or predetermined data associated with antenna characteristics, and the algorithm is configured to optimize the system performance with reference to the entries in the LUT 416 according to the selected band and time-varying conditions/environments, such as perturbations due to the placement of a head, a hand, or other interference-causing objects nearby. The entries in the LUT 416 can be updated as needed, and the LUT 416 may be stored in a memory of the controller 412 or located outside the controller 412. The controller 412 and/or the LUT 416 can be implemented using a logic chip, such as a field-programmable gate array (FPGA), which supports thousands of gates, providing vast design flexibility. Alternatively, an application specific integrated circuit (ASIC) can also be used.

Bidirectional control can be realized, for example, by using an interface specified by the Mobile Industry Processor Interface (MIPI) Alliance, General Purpose Input/Output (GPIO), Serial Parallel Interface (SPI), or Inter-Integrated Circuit ($I^2C$). See, for example, a white paper entitled "Tuning Technology: Key Element to Lower Operating Costs While Improving Wireless Network Performance," released on Feb. 8, 2011, by IWPC (International Wireless Industry Consortium). The control lines 424 may be designed to incorporate such bidirectional control using a conventional bus, wires, or other suitable forms.

The communication system of FIG. 4, Which includes the multiple-feed antenna and the multi-port switch, can be used as a "plug-and-play" module, being portable and interchangeable for different laptops, tablets, personal digital assistants, cellular phones, smart phones and other mobile devices. The software associated with the controller 412 and LUT 416, as well as the specific values associated with the bidirectional interface may need minor adjustment upon changing the device for the communication system to be plugged in. The portability may be further enhanced by integrating the controller 412 and the LUT 416.

FIG. 5 illustrates an example of the LUT 416. Measured and/or predetermined parameters under various conditions and/or specifications may be stored in the LUT 416 to adjust impedances and other properties. For example, the LUT 416 may include characterization data of the antenna 404, such as total radiated power (TRP), total isotropic sensitivity (TIS), specific absorption rate (SAR), radiation patterns and so on, which can be measured in advance for various conditions, e.g., in free space, in the presence of a head, a hand, laps, wood, metal, etc. with different positions and angles. Measured S parameters such as S12 and S11 may also be included. These LUT entries may be updated as needed so that the algorithm can converge faster to an optimum operation. The example in FIG. 5 shows a portion of the LUT 416, where the capacitance and inductance values, C1, C2, L1, L2, . . . in the cells of the tunable matching networks are listed according to conditions and bands. For example, condition 1 may refer to the presence of a head with an ear in parallel with the handset; condition 2 may refer to the presence of a metal touching the handset, etc. The device is assumed to operate over four bands 1, 2, 3, and 4 in this table; for example, the frequencies for the Tx of band 1 are 1920-1980 MHz, and the frequencies for the Rx of band 1 are 2110-2170 MHz, the frequencies for the Tx of band 2 are 1850-1910 MHz, and the frequencies for the Rx of band 2 are 1930-1950 MHz, the frequencies for the Tx of band 3 are 1710-1785 MHz, and the frequencies for the Rx of hand 3 are 1805-1880 MHz, etc. The capacitance and inductance values may be predetermined through measurements of the S parameters, for example, for each band under each condition. The condition during a time interval can be detected by the sensor 420, and the information can be sent to the controller 412. The information on the selected frequency band during the time interval can be sent from a CPU or an application CPU in the system to the controller 412. The controller 412 refers to the LUT 416 to determine the values of C1, C2, L1, L2 . . . that can provide the optimum impedance state to recover optimum performances under the condition and for the selected band during the time interval. The predetermined impedance states, as tabulated in the LUT 416, are implemented by the cells of the tunable matching networks, such as illustrated in FIG. 3. Accordingly, the controller 412 turns on one or more switches coupled to the cells that provide the optimum impedance for the band and the condition during the time interval.

Referring back to 3, in which an example of the tunable matching network is illustrated, this configuration can be used as a shunt circuit or a series circuit. For shunt, the ports 1 and 2 may be coupled to the RF path, with an option of coupling port 3 to another circuit, module or component in the system, shorting it to ground or keeping it open. For series, the port 1 (or 2) and the port 3 may be coupled to the RF path, with an option of coupling port 2 (or 1) to another circuit, module or component in the system, shorting it to ground or keeping it open. Referring back to FIG. 4, the multi-port switch 408 in this example includes multiple tunable matching networks, TMN 1, TMN 2 . . . and TMN N, each of which is configured to be in shunt with the path. However, one or more of the matching networks may be configured in series and the others may be configured in shunt; all may be configured in shunt; or all may be configured in series. Furthermore, one or more paths may be configured without the respective tunable matching networks. Additionally, one tunable matching network may be configured to couple to two or more paths to adjust impedances for the two or more groups of bands supported by the two or more paths.

Figure 6B:
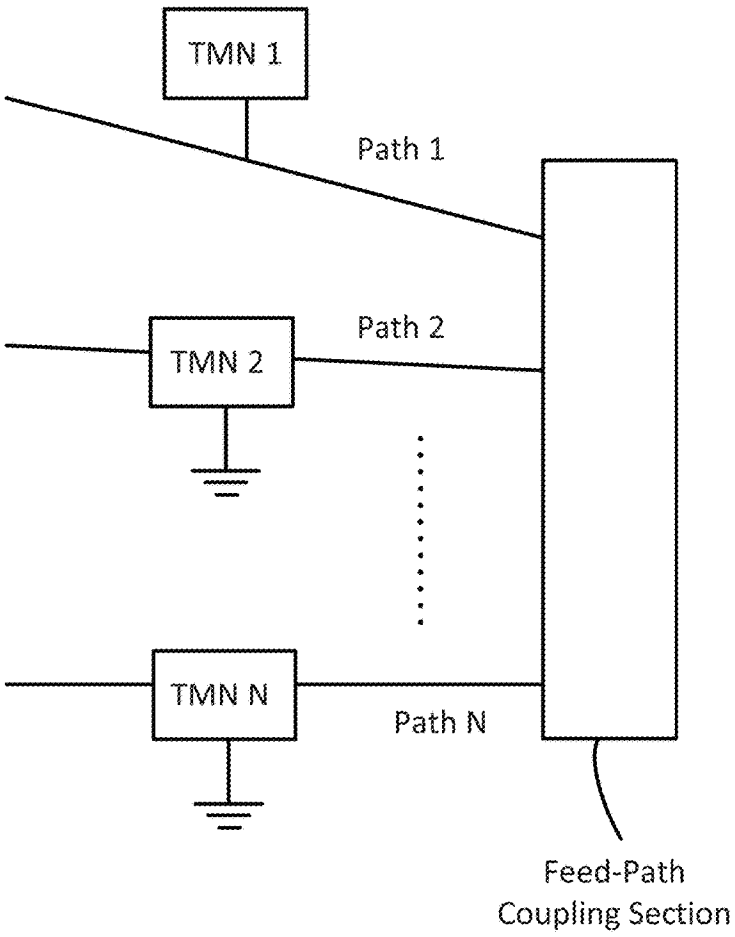
FIGS. 6A-6D illustrate examples of configuration variations of the tunable matching networks in the multi-port switch.
Figure 6A:
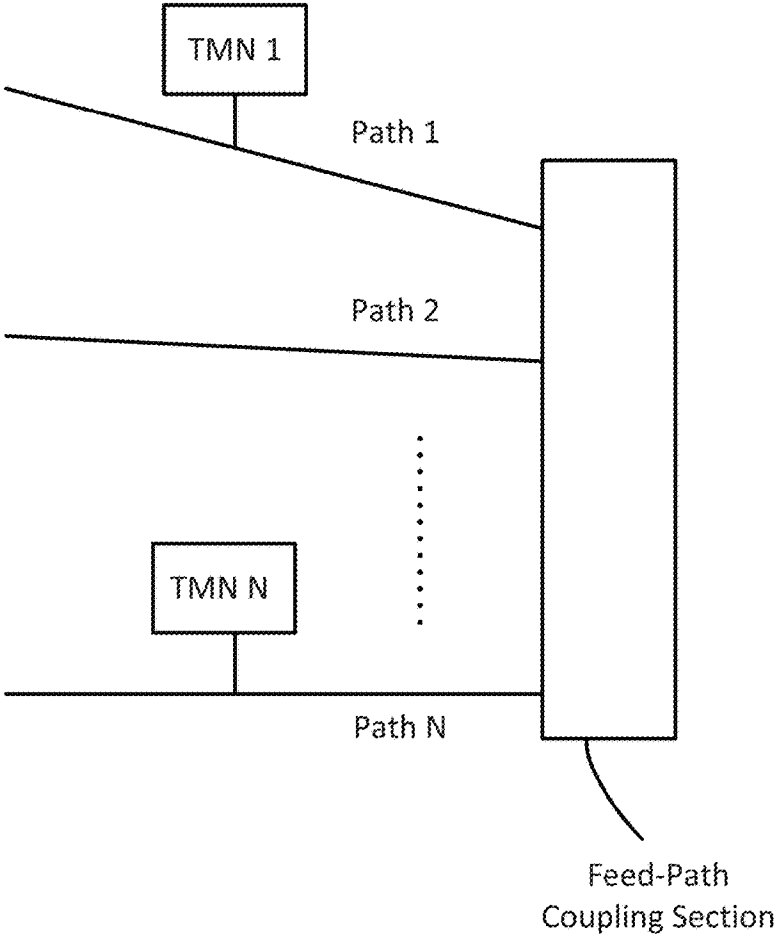
Figure 6D:
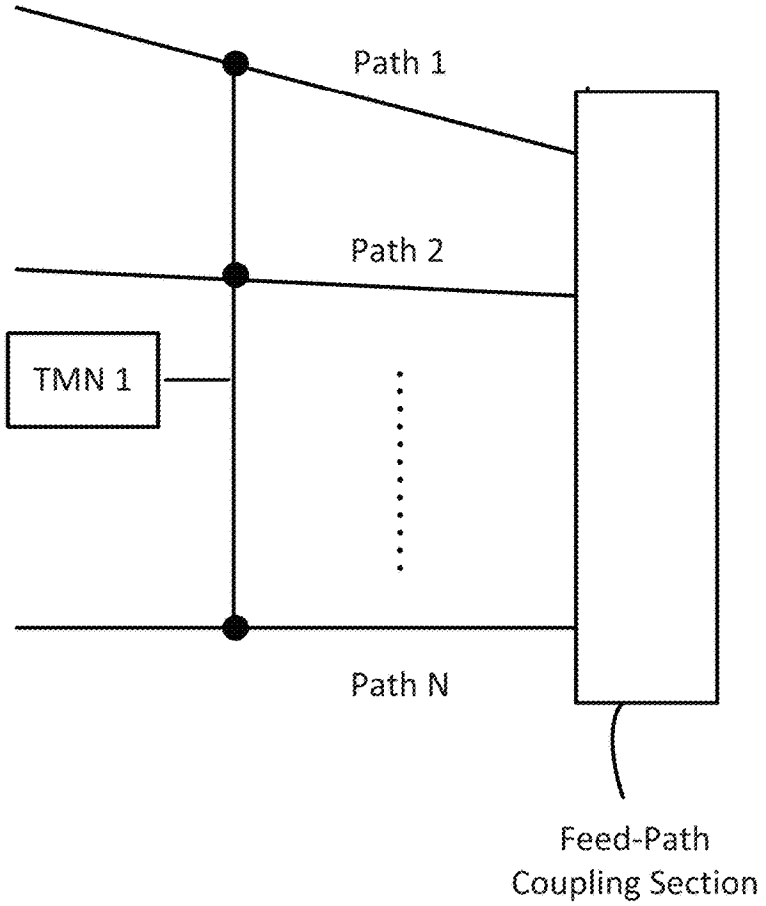
Figure 6C:
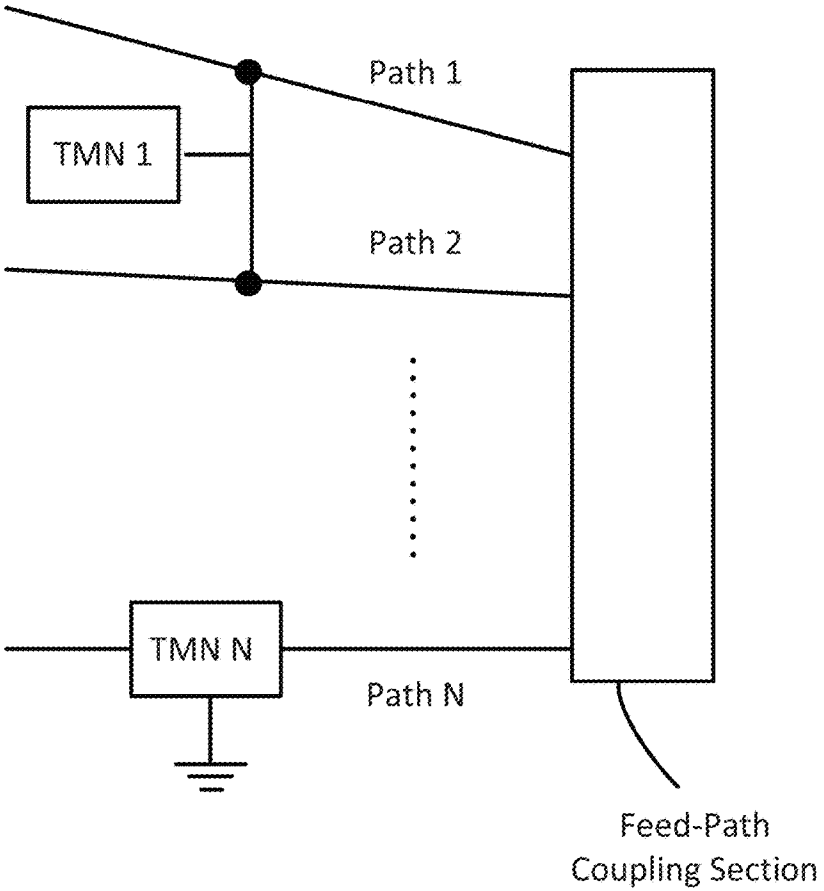

FIGS. 6A-6D illustrate examples of configuration variations of the tunable matching networks in the multi-port switch 408. FIG. 6A illustrates an example wherein TMN 1 is coupled in shunt with the path 1 with the other end open; no tunable matching network is used for the path 2; and TMN N is coupled in shunt with the path N with the other end open. FIG. 6B illustrates an example wherein TMN 1 is coupled in shunt with the path 1 with the other end open; TMN 2 is coupled in series with the path 2 with the other end shorted to ground; and TMN N coupled in series with the path N with the other end shorted to ground. FIG. 6C illustrates an example wherein TMN 1 is coupled to the paths 1 and 2 in shunt with the other end open; and TMN N is coupled to the path N in series with the other end shorted to ground. FIG. 6D illustrates an example wherein TMN 1 is coupled to the paths 1, 2 and N in shunt with the other end open.

Figure 7:
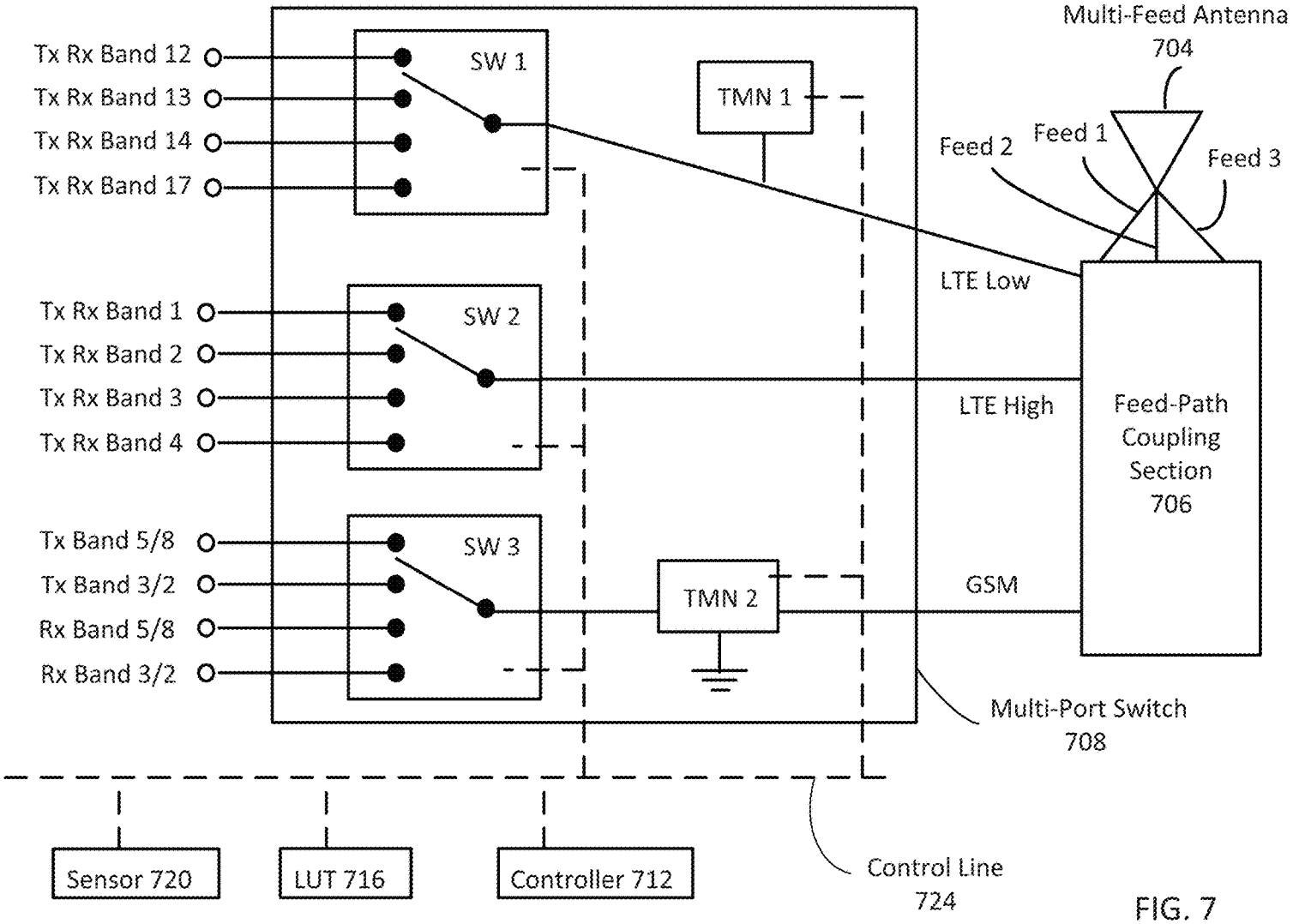
FIG. 7 illustrates a specific example of a configuration of a communication system, the configuration incorporating a multi-feed antenna and tunable matching networks.

FIG. 7 illustrates a specific example of a configuration of a communication system, the configuration incorporating a multi-feed antenna and tunable matching networks. FIG. 8 is a table showing the modes and frequency bands that are processed by using the communication system of FIG. 7. This system includes a multi-feed antenna 704, which is a single antenna for transmit (Tx) and receive (Rx) in this example, and a multi-port switch 708. The multi-feed antenna 704 is configured to couple to three paths, labeled LTE Low, LTE High and GSM. Examples of multi-feed antennas are described in commonly owned U.S. application Ser. No. 13/548,211, entitled "MULTI-FEED ANTENNA FOR PATH OPTIMIZATION," filed on Jul. 13, 2012, such as illustrated in FIG. 2. However, antennas with any type of multi-feed techniques and configurations can be used in the present system. For example, a power combiner/divider may be used to provide multiple feeds. The multi-feed antenna 704 is configured to couple to the three RE paths through a feed-path coupling section 706. The feed-path coupling section 706 is configured to couple the antenna feed 1, feed 2 and feed 3 to the three paths, respectively, in a capacitive way, an inductive way, a combination of both or other suitable methods. The path labeled LTE Low is configured to support RE signals in a first group of bands, Bands 12, 13, 14, and 17 for both Tx and Rx, as shown in FIG. 8. The path labeled LTE High is configured to support RE signals in a second group of bands, Bands 1, 2, 3 and 4 for both Tx and Rx, as shown in FIG. 8. The path labeled GSM is configured to support RF signals in a third group of bands, Bands 2, 3, 5 and 6 for both Tx and Rx, as shown in FIG. 8. The multi-port switch 708 is configured to couple to the three paths on one side and another multiple paths on the other side to process signals respectively in the multiple bands. The multi-port switch 708 includes multiple single-pole-multiple-throw switches, labeled SW 1, SW 2 and SW 3, corresponding to the first group of bands, the second group of bands and the third group of bands, respectively. Each of the single-pole-multiple-throw switches is used to engage one of the paths corresponding to one of the bands in the group to process the signal in the particular band. In this example, the path LTE Low is split into four paths, labeled Tx Rx Band 12, Tx Rx Band 13, Tx Rx Band 14 and Tx Rx Band 17, supporting the Tx and Rx signals in Bands 12, 13, 14 and 17, respectively. The switch SW 1 is used to engage one of the four paths according to the frequency band of the signal. The path LTE High is split into four paths, labeled Tx Rx Band 1, Tx Rx Band 2, Tx Rx Band 3 and Tx Rx Band 4, supporting the Tx and Rx signals in Bands 1, 2, 3 and 4, respectively. The switch SW 2 is used to engage one of the four paths according to the frequency band of the signal. The path GSM is split into four paths, labeled Tx Band 5/8, Tx Band 3/2, Rx Band 5/8 and Rx Band 3/2, supporting the Tx signals in Bands 5 and 8, the Tx signals in Bands 3 and 2, the Rx signals in Bands 5 and 8 and the Rx signals in Bands 3 and 2, respectively. The switch SW 3 is used to engage one of the four paths according to the frequency band of the Tx or Rx signal. The multi-port switch 708 further includes multiple tunable matching networks, labeled TMN 1 and TMN 2, coupled to the path LTE Low and the path GSM, respectively. Each of the tunable matching networks is used to dynamically provide optimum impedance for one of the bands selected in the group and the condition detected during each time interval. In this example, TMN 1 is coupled in shunt with the path LTE Low, and TMN 2 is coupled in series with the path GSM, while no tunable matching network is used for the path LTE High.

A controller 712, a look-up table (LUT) 716 and a sensor 720 are coupled to each other through a control line 724, enabling the controller 712 to adjust the tunable matching networks, TMN 1 and TMN 2 based on input information. The controller 712 may be further configured to control the single-pole-multiple-throw switches, SW 1, SW 2 and SW 3, to engage the paths corresponding to the bands to be processed, respectively. The sensor 720 may include one or more sensors such as a proximity sensor, a motion sensor, a light sensor, a pressure sensor or other types of sensors, to detect the use condition and/or the environment and send the detected information to the controller 712. The controller 712 is configured to include an algorithm to control each of the tunable matching networks to dynamically adjust the impedance according to the frequency band selected and the condition/environment detected during a time interval. The LUT 716 tabulates measured and/or predetermined data associated with antenna characteristics, and the algorithm is configured to optimize the system performance with reference to the entries in the LUT 716 according to the selected band and time-varying conditions/environments, such as perturbations due to the placement of a head, a hand, or other interference-causing objects nearby.

The configuration example of FIGS. 7 and 8 provides three antenna feeds to couple to three paths to support the three groups of bands, LTE Low, LTE High and GSM. Bands 12, 13, 14 and 17 are clustered in low MHz, and Bands 1, 2, 3 and 4 are clustered in high MHz; thus, the design choice is made to provide the first-order isolation between these two groups, LTE Low and LTE High, via the two separate paths, and then the isolation and impedance matching can be fine-tuned by TMN 1 for the group of bands in LTE Low. Additionally, the FDD (frequency-division duplex) scheme can be employed for LTE so that the Tx and Rx bands have a duplex spacing in the frequency domain, and thus the Tx and Rx signals can be processed in the same path. In this scenario, duplexers can be included in the RF front end circuit, and the ports for Tx Rx Band 12-17 and for Tx Rx Band 1-4 may be coupled to the respective duplexers for branching out the Tx and Rx signals. On the other hand, the GSM signals generally have a high power level, and thus need to be separated from the other hands. The first-order isolation is provided by the separate path, labeled GSM, coupled to the third feed of the multi-feed antenna 704. Then, the isolation and impedance matching can be fine-tuned by TMN 2 for the group of bands in GSM. Additionally, the TDD (time-division duplex) scheme can be employed for GSM so that the Tx and Rx signals may be separated in different paths, and thus there is no need for duplexers in the RF front end circuit. However, two bands that are close in MHz, i.e., Bands 5 and 8 as well as Bands 2 and 3, can share the same path, since the PAs and LNAs can be included in the RF front end circuit to segregate the two bands in the time domain.

Figure 9:
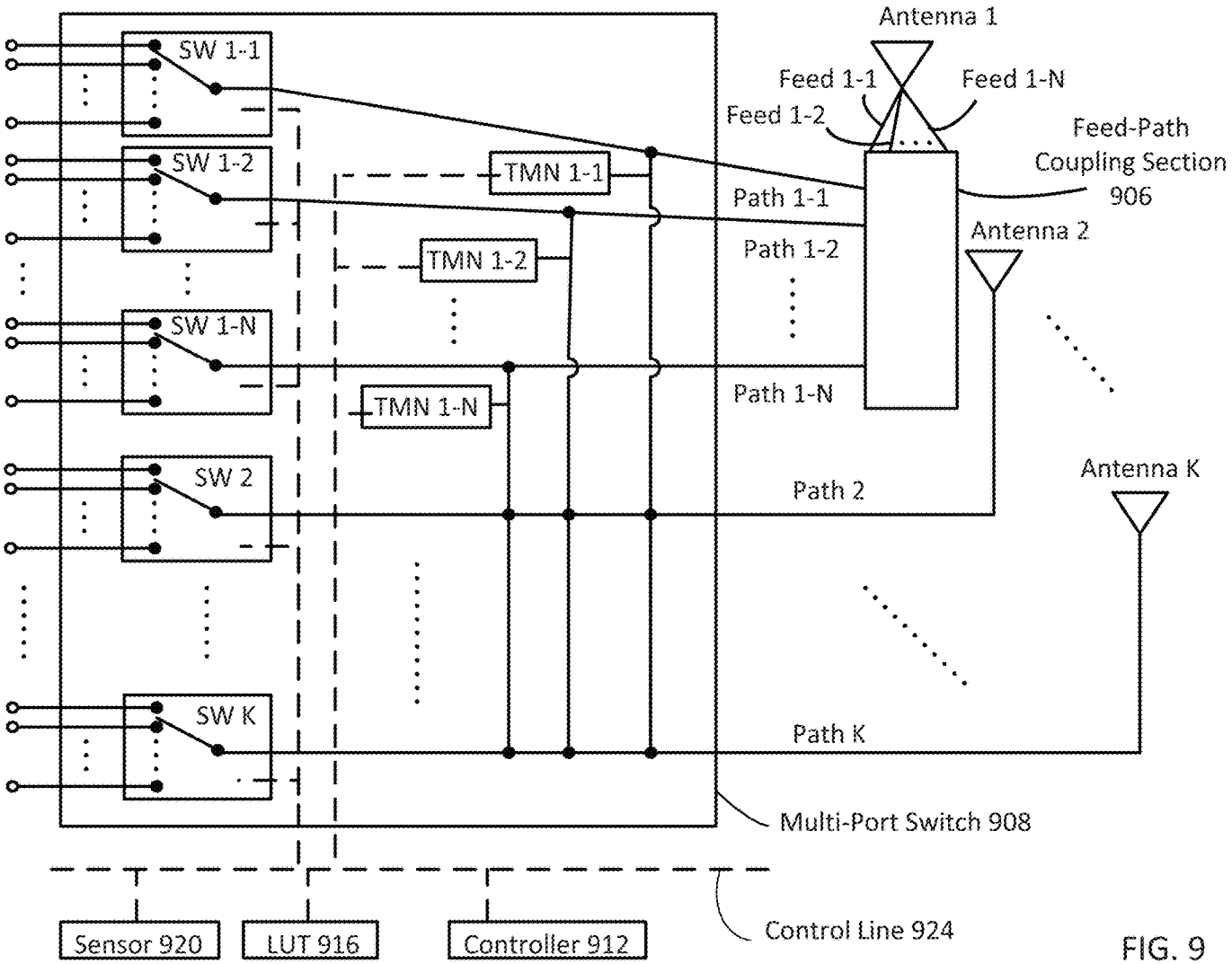
FIG. 9 illustrates an example of a configuration of a communication system, the configuration incorporating multiple antennas and tunable matching networks.

FIG. 9 illustrates an example of a configuration of a communication system, the configuration incorporating multiple antennas and tunable matching networks. This system includes at least one multi-feed antenna, labeled Antenna 1, among the multiple antennas, labeled Antenna 1, Antenna 2 . . . and Antenna K, where K is the number of antennas. In this system, one or more of the antennas and even all of the antennas may be configured to be multi-feed antennas, or all of the antennas may be configured to be single-feed antennas. Each of these antennas handles transmit (Tx) and receive (Rx) in this example. The multi-feed antenna, Antenna 1, is configured to couple to path 1-1, path 1-2 . . . and path 1-N, where N is the number of feeds of Antenna 1. Examples of multi-feed antennas are described in commonly owned U.S. application Ser. No. 13/548,211, entitled "MULTI-FEED ANTENNA FOR PATH OPTIMIZATION," filed on Jul. 13, 2012, such as illustrated in FIG. 2. However, antennas with any type of multi-feed techniques and configurations can be used in the present system. For example, a power combiner/divider may be used to provide multiple feeds. The multi-feed antenna, Antenna 1, is configured to couple to path 1-1, path 1-2 . . . and path 1-N through a feed-path coupling section 906, where N is the number of feeds of the multi-feed antenna 904. The feed-path coupling section 906 is configured to couple the antenna feed 1-1, feed 1-2 . . . and feed 1-N to the path 1-1, path 1-2 . . . and path 1-N, respectively, in a capacitive way, an inductive way, a combination of both or other suitable methods. The single-feed antennas are respectively coupled to separate paths, for example, Antenna 2 coupled to path 2 and Antenna K coupled to path K. Each path is configured to support RF signals in a group of bands. The multi-port switch 908 is configured to couple to multiple paths from the antennas, Antenna 1, Antenna 2 . . . and Antenna K, on one side and another multiple paths on the other side to process signals respectively in multiple bands. The multi-port switch 908 includes multiple single-pole-multiple-throw switches, labeled SW 1-1, SW 1-2 . . . and SW 1-N, corresponding to the N groups of bands, respectively, which are transmitted or received by the multi-feed antenna, Antenna 1. The multi-port switch 908 further includes single-pole-multiple-throw switches, labeled SW 2 . . . SW K, corresponding to the bands supported by path 2 . . . path K, respectively. Each of the single-pole-multiple-throw switches is used to engage one of the paths corresponding to one of the bands in the group to process the signal in the particular band. The multi-port switch 908 further includes multiple tunable matching networks, labeled TMN 1-1, TMN 1-2 . . . and TMN 1-N. In this example, TMN 1-1 is coupled in shunt with path 1-1, path 2 and path K; TMN 1-2 is coupled in shunt with path 1-2, path 2 . . . and path K; and TMN 1-N is coupled in shunt with path 1-N, path 2 . . . and path K. Each of the tunable matching networks is used to dynamically provide optimum impedance for the frequency band selected and the condition detected during each time interval.

A controller 912, a look-up table (LUT) 916 and a sensor 920 are coupled to each other through a control line 924, enabling the controller 912 to adjust the tunable matching networks, TMN 1-1, TMN 1-2 . . . and TMN 1-N based on input information. The controller 912 may be further configured to control the single-pole-multiple-throw switches, SW 1-1, SW 1-2 . . . and SW 1-N and SW 2 and SW K, to engage the paths corresponding to the bands to be processed, respectively. The sensor 920 may include one or more sensors such as a proximity sensor, a motion sensor, a light sensor, a pressure sensor or other types of sensors, to detect the use condition and/or the environment and send the detected information to the controller 912. The controller 912 is configured to include an algorithm to control each of the tunable matching networks to dynamically adjust the impedance according to the frequency band selected and the condition/environment detected during a time interval. The LUT 916 tabulates measured and/or predetermined data associated with antenna characteristics, and the algorithm is configured to optimize the system performance with reference to the entries in the LUT 916 according to the selected band and time-varying conditions/environments, such as perturbations due to the placement of a head, a hand, or other interference-causing objects nearby.

The communication system having multiple antennas, as illustrated in FIG. 9, can he used for a transmit section of a MIMO (Multiple Input Multiple Output) system, a receive section of a MIMO system, an Rx diversity system, or a Tx diversity system. When used for the Rx or Tx diversity system, one or more of the single-feed antennas, such as Antenna 2 . . . and Antenna K, may be used as the diversity antennas. When multiple antennas are included in the system, certain changes in conditions/environments affecting one of the multiple antennas may also affect the other antennas due to electromagnetic interactions among the antennas causing antenna coupling. In particular, when the system is implemented in a limited space of a mobile device, coupling between antennas is likely to occur due to the proximity effects. For example, detuning caused by a head, a hand or other interference-causing objects placed near one antenna can also affect the other antennas through antenna coupling. In such a complex case, each path needs to be retuned iteratively to achieve optimum system performances. Each of the tunable matching networks, TMN 1-1, TMN 1-2 . . . and TMN 1-N in FIG. 9, for example, is thus configured to couple to the multiple paths, which are coupled to the multiple antennas, respectively, in order to adjust the impedance values for the multiple paths dynamically and iteratively based on information about the antenna coupling, such as perturbed properties of one antenna affecting the others. Such iterative control and feedback information for the tunable matching networks are provided by the controller 912, LUT 916 and sensor 920 through the control line 924.

As the wireless communication technologies advance, the volume of data transmission is required to be larger with even faster speed. This motivates to obtain communication channels with wider bandwidths and efficient use of fragmented spectrum. For this purpose, the "carrier aggregation" scheme has been devised, wherein two or more component carriers are aggregated to support wide bandwidths. In Release 10 of LTE-Advanced, for example, the data throughput is expected to reach 1 Gbps. Carrier aggregation may achieve a 100 MHz bandwidth by combining different carriers. There are three carrier aggregation modes to date: intra-hand contiguous allocation, intra-band non-contiguous allocation and inter-band allocation. The intra-band contiguous allocation contiguously aggregates components carriers, each having a 1.4 MHz bandwidth up to a 20 MHz bandwidth, in one band. The intra-band non-contiguous allocation non-contiguously aggregates component carriers in one band, thereby having gaps between some of the component carriers; however, note that this carrier aggregation is not supported by the Release 10 at present time. The inter-band allocation aggregates component carriers in different bands, resulting in a non-contiguous allocation with gaps. The carrier aggregation scheme thus allows for simultaneous transmit or receive, which pose new challenges in RF front end circuit and antenna designs, modulations/demodulations and various other RF techniques. However, the communication system described in this document allow for simultaneous transmit or receive of signals in multiple hands with optimum impedance for each band. This is enabled by the use of the tunable matching networks, each of the tunable matching networks incorporating predetermined tailored impedance states to provide the optimum impedance for a band selected and a condition detected during a time interval. Carrier aggregation can he supported by the present communication system with two or more single-feed antennas, one or more multi-feed antennas, or combination of both types of antennas.

Figure 10:
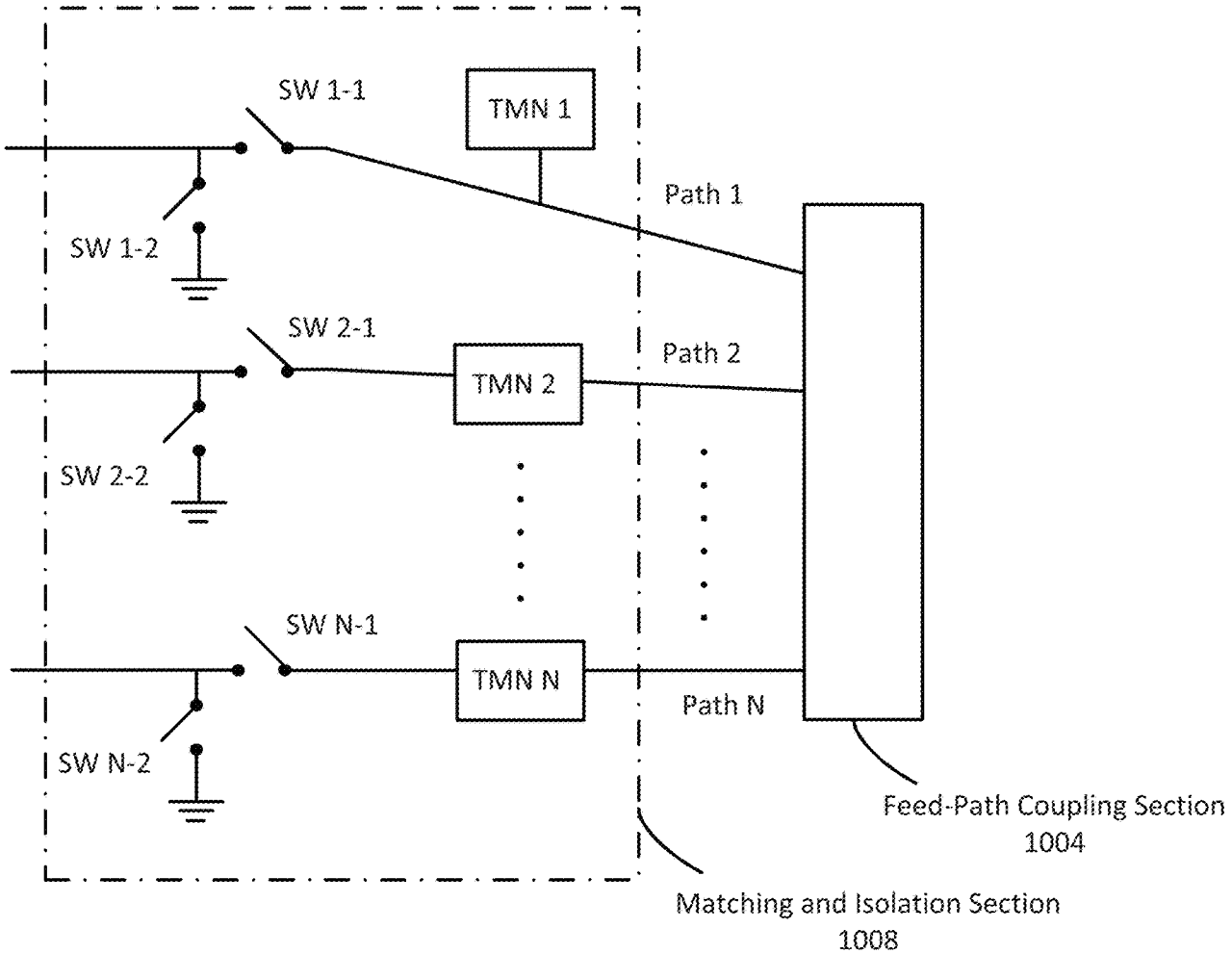
FIG. 10 illustrates an example of a configuration including switches for each path to improve isolation.

In the configuration examples so far, isolation and matching are considered primarily based on the tunable matching networks and the multi-feed antenna structure. The isolation of the system can be further enhanced by including switches for the RF paths. FIG. 10 illustrates an example of a configuration including switches to enhance isolation. A multi-feed antenna (not shown in FIG. 10) is configured to couple to path 1, path 2 . . . and path N through a feed-path coupling section 1004, where N is the number of feeds of the multi-feed antenna. The feed-path coupling section 1004 is configured to couple the antenna feed 1, feed 2 . . . and feed N to the path 1, path 2 . . . and path N, respectively, in a capacitive way, an inductive way, a combination of both or other suitable methods. The path 1 is configured to support RF signals in a first group of bands; the path 2 is configured to support RF signals in a second group of bands; . . . ; and the path N is configured to support RF signals in an N-th group of bands. Multiple tunable matching networks, labeled TMN 1, TMN 2 . . . and TMN N, are coupled to the path 1, path 2 . . . and path N, respectively, in this example. As in the example of FIG. 4, each of the tunable matching networks is used to dynamically provide optimum impedance for the hands in the group and the condition detected during each time interval. Additional to the tunable matching networks, the configuration of FIG. 10 includes a pair of switches in shunt and in series for each path. For example, the path 1 has a series switch SW 1-1 and a shunt switch SW 1-2; the path 2 has a series switch SW 2-1 and a shunt switch 2-2; . . . ; and the path N has a series switch SW N-1 and a shunt switch SW N-2. These switches may be controlled to provide enhanced isolation. For example, the series switch for the path 1, SW 1-1, may be turned on and the shunt switch for the path 1, SW 1-2, is turned off; while the series switch for the path 2, SW 2-1, is turned off and the shunt switch for the path 2, SW 2-2, is turned on. This switch state provides improved isolation for the paths 1 and 2 when the signal is transmitting in the path 1 by shutting off the path 2, thereby reducing power leakage. The circuit section including the tunable matching networks and the associated switches is referred to a matching and isolation section 1008, which is indicated by a dashed-dotted line in FIG. 10.

Figure 10B:
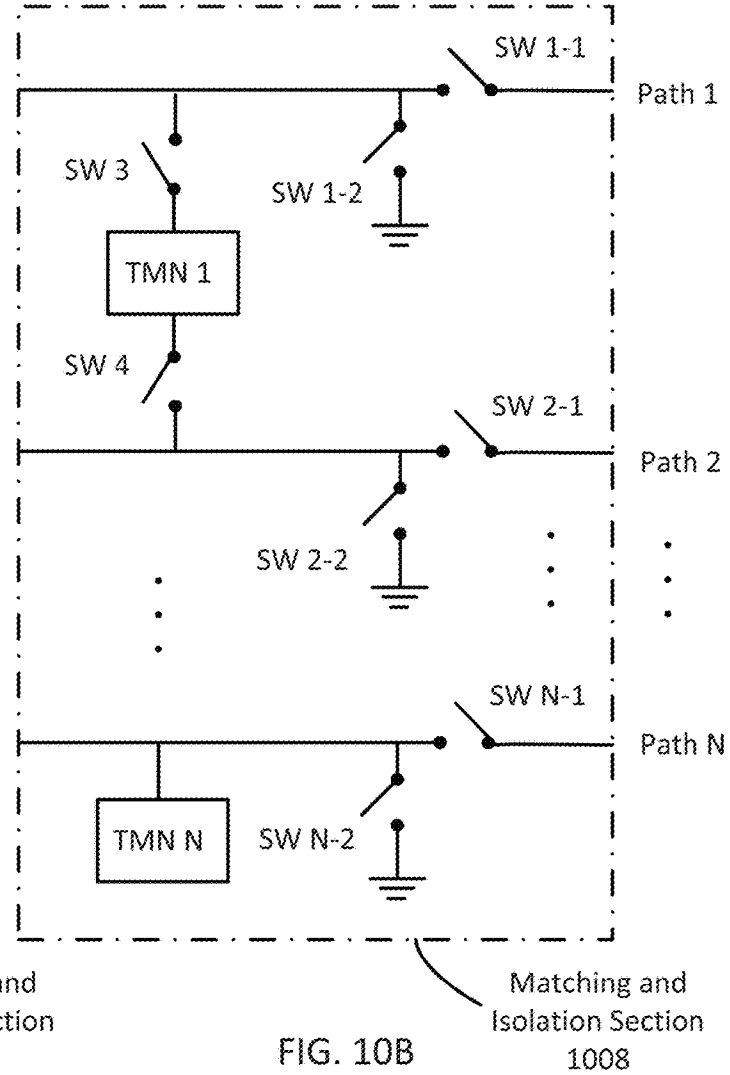
FIGS. 10A and 10B illustrate configuration variations of the tunable matching networks and switches in a matching and isolation section.
Figure 10A:
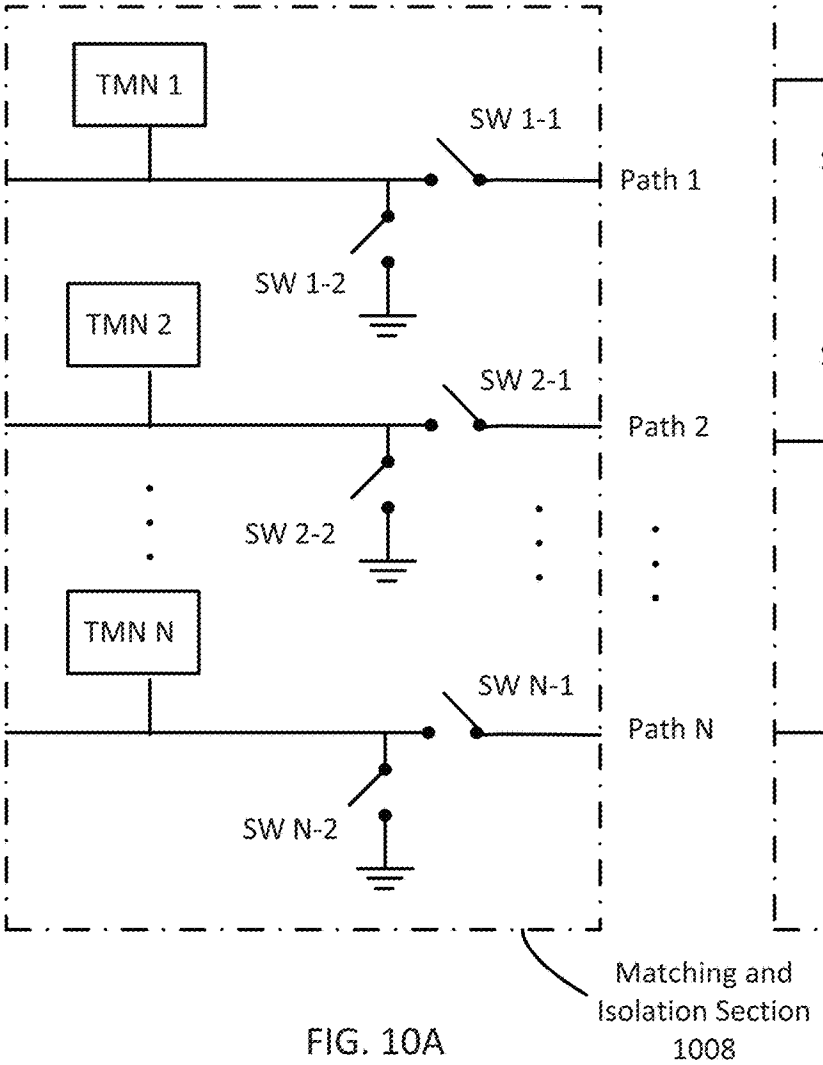

As explained with reference to FIGS. 6A-6D, each tunable matching network may be coupled to the path in shunt or in series. Furthermore, one tunable matching network may be designed to handle multiple groups of bands in multiple paths. Additionally, the switches in the matching and isolation section can be placed on either side of the tunable matching networks. The matching and isolation section 1008 in FIG. 10 illustrates an example in which TMN 1 is coupled in shunt with the path 1, TMN 2 is coupled in series with the path 2, . . . and TMN N is coupled in series with the path N, and the switches are coupled to the tunable matching networks on the output side of the receive signals from the antenna. Alternatively, a number of variations can be configured for the matching and isolation section. FIGS. 10A and 10B illustrate configuration variations of the tunable matching networks and switches in the matching and isolation section 1008. FIG. 10A illustrates an example in which the series and shunt switches are placed on the antenna side of the tunable matching networks, TMN 1 is coupled in shunt with the path 1, TMN 2 is coupled in shunt with the path 2, . . . and TMN N is coupled in shunt with the path N. FIG. 10B illustrates an example in which TMN 1 is coupled in shunt with the path 1 through a switch SW 3 and is also coupled in shunt with the path 2 through a switch SW 4. The switches associated with the paths 1 and 2 may be controlled to enhance isolation while providing proper matching. For example, the signals for the path 1 can be processed with high isolation and matching by turning on the switches SW 1-1, SW 3 and SW 2-2, while leaving the switches SW 1-2, SW 4 and SW 2-1 off. Similarly, the signals for the path 2 can be processed with high isolation and matching by turning on the switches SW 2-1, SW 4 and SW 1-2, while leaving the switches SW 2-2, SW 3 and SW 1-1 off. Therefore, by controlling the switches, TMN 1 can be engaged with the path that is engaged for signal processing by turning on the associated series switch, while being disengaged from the other path.

In a configuration where a tunable matching network is coupled to multiple paths as in the example of FIG. 10B, the switches placed between the tunable matching network and the coupled paths, respectively, such as SW 3 and SW 4 in FIG. 10B, may be integrated in the tunable matching network. Alternatively, the impedance states configured in the tunable matching network based on cells and switches as shown in FIG. 3, for example, may be further configured to include a high impedance state to simulate an "off state" that is otherwise provided by turning off the switch such as SW 3 or SW 4. Therefore, by controlling the tunable matching network to have the high impedance state, the tunable matching network can be engaged with the path that is engaged for signal processing by turning on the associated series switch, while being disengaged from the other path.

Figure 10D:
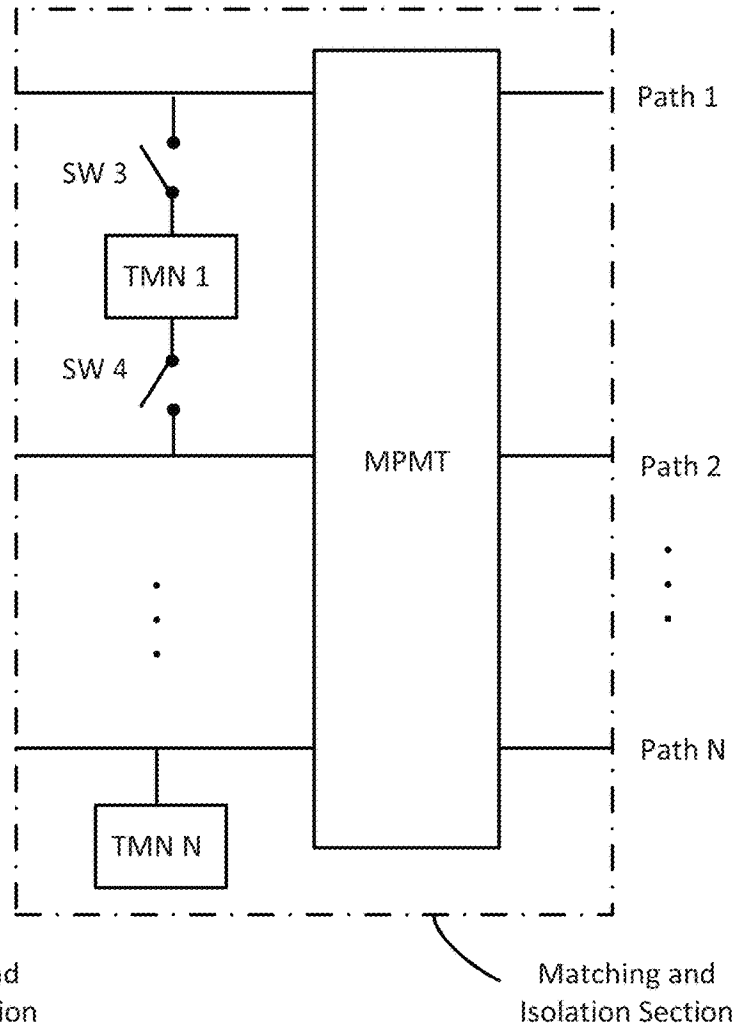
FIGS. 10C and 10D illustrate configuration examples of the matching and isolation section including a multiple-pole-multiple-throw (MPMT) switch.
Figure 10C:
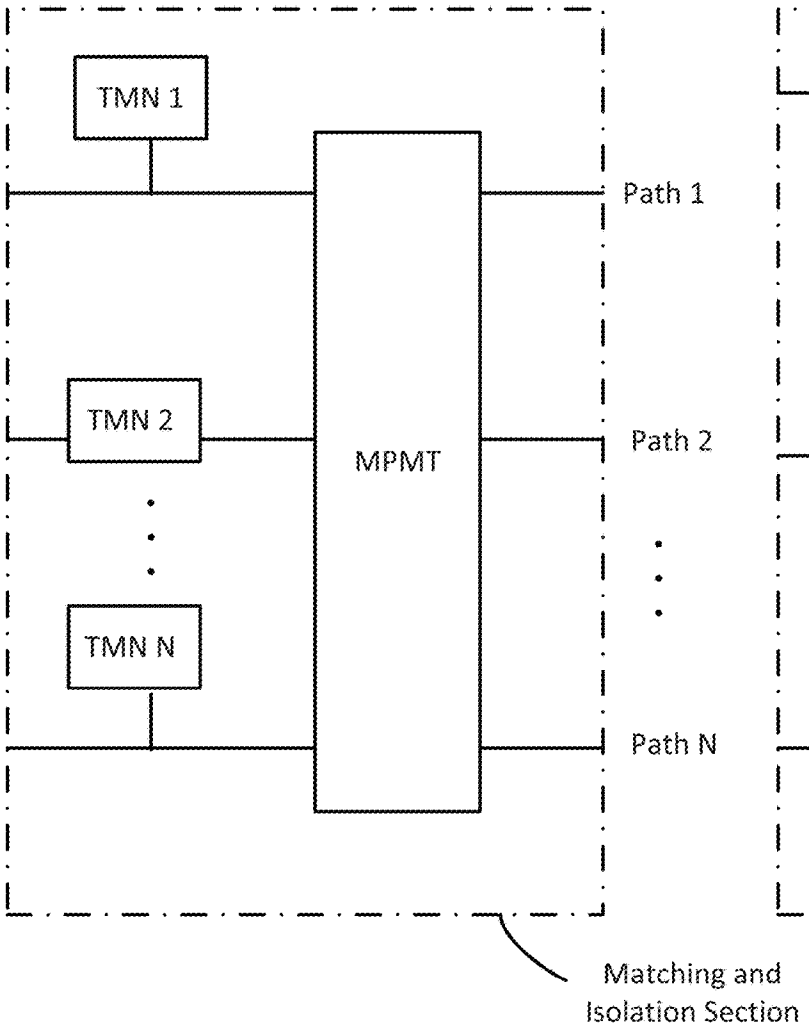

In the above examples, the switches are represented as single-pole-single-throw (SPST) switches. Part or all the multiple SPST switches in the matching and isolation section 1008 may be replaced with a multiple-pole-multiple-throw (MPMT) switch having N-number of input ports and M-number of output ports. When N=M, the MPMT switch is called symmetric; when N≠M, it is called asymmetric. FIG. 10C illustrates an example of a configuration of the matching and isolation section 1008 including an MPMT switch. The tunable matching networks, TMN 1, TMN 2 . . . and TMN N, are coupled respectively to the RF paths, path 1, path and path N, each in shunt or in series in this example.

The MPMT is configured to include the functionality corresponding to one or more SPST switches in shunt and/or one or more SPST switches in series. FIGS. 10D illustrates another example of a configuration of the matching and isolation section 1008 including an MPMT switch. The tunable matching network TMN 1 is coupled in shunt with the path 1 through a switch SW 3 and is also coupled in shunt with the path 2 through a switch SW 4 in this example. The other tunable matching networks are coupled to their respective paths, each in shunt or in series. The MPMT is configured to include the functionality corresponding to one or more SPST switches in shunt and/or one or more SPST switches in series.

Figure 10E:
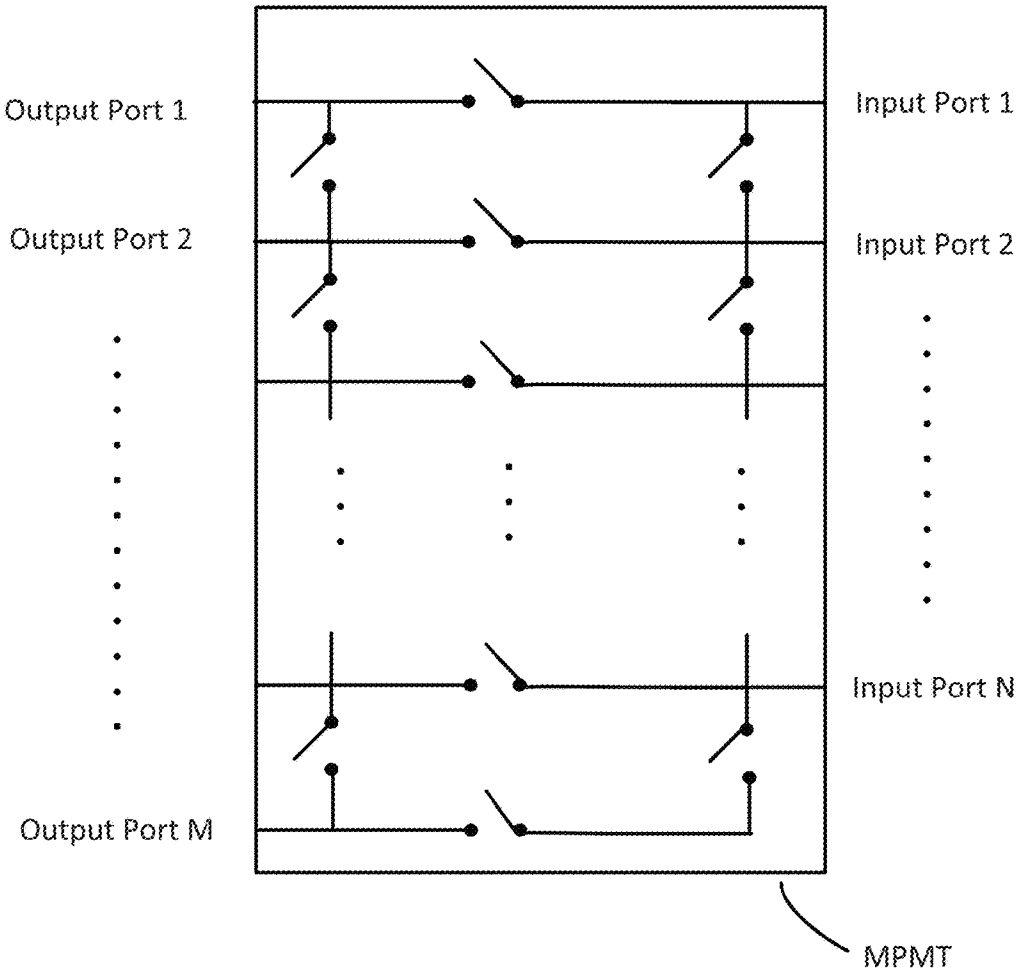
FIG. 10E illustrates an example of a configuration of single-pole-single-throw (SPST) switches in an MTMP switch.

FIG. 10E illustrates an example of a configuration of SPST switches in an MTMP switch. This example illustrates an asymmetric case where there are input ports 1, 2 . . . and N, and output ports 1, 2 . . . and M. This can be made symmetric by configuring the switches to have M=N. Each SPST switch in shunt may have an open end or be coupled to another RF path, a component, a module or to ground. The input ports and output ports may be flipped. The shunt switches and the series switches may be placed in the MPMT in a symmetric fashion, asymmetric fashion, or any configuration. Thus, the number and the configuration of the SPST switches in the MPMT switch may be varied in a wide variety of ways depending on applications.

Figure 10F:
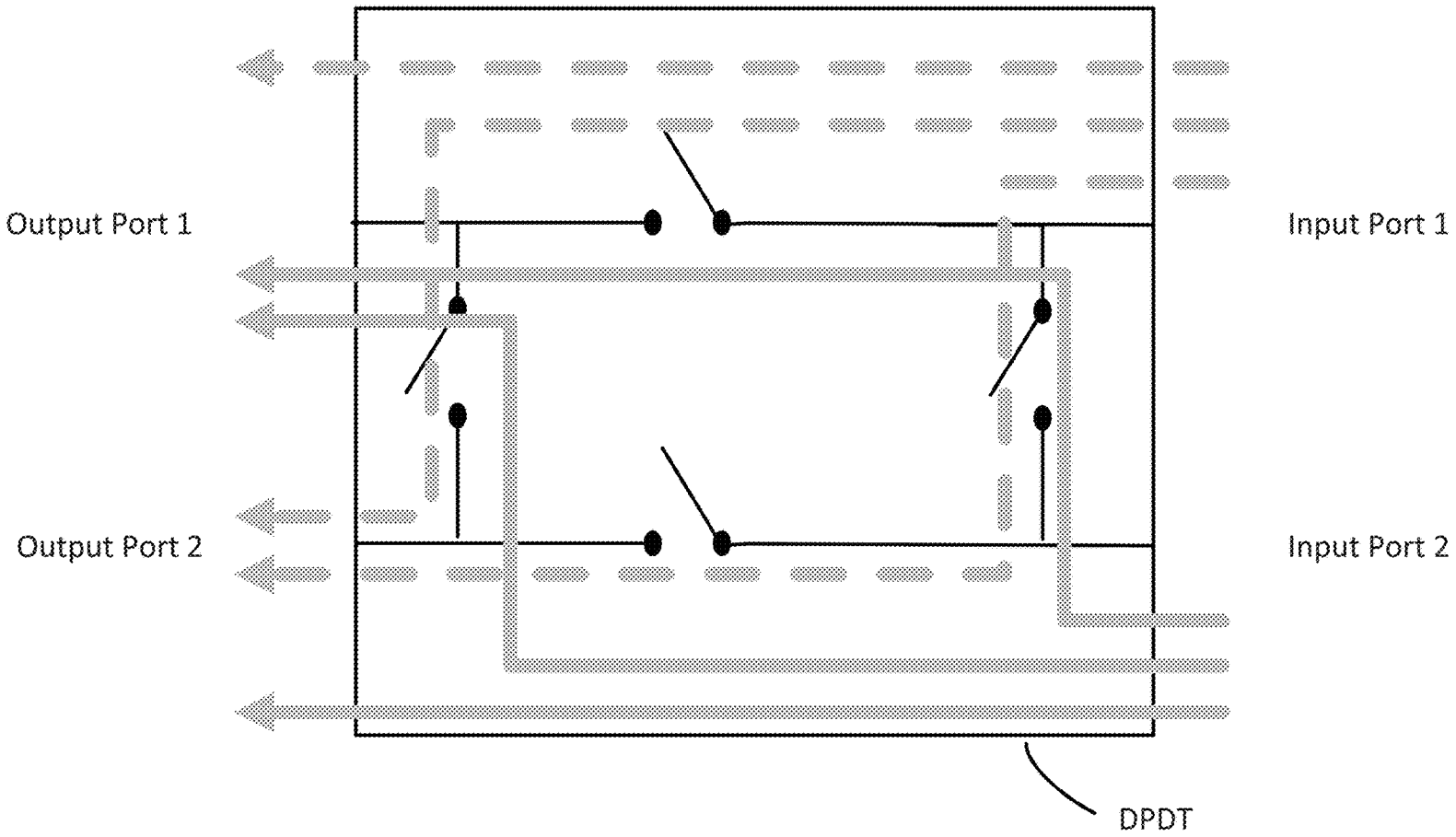
FIG. 10F illustrates an example of a configuration of SPST switches in a double-pole-double-throw (DPDT) switch.
Figure 10G:
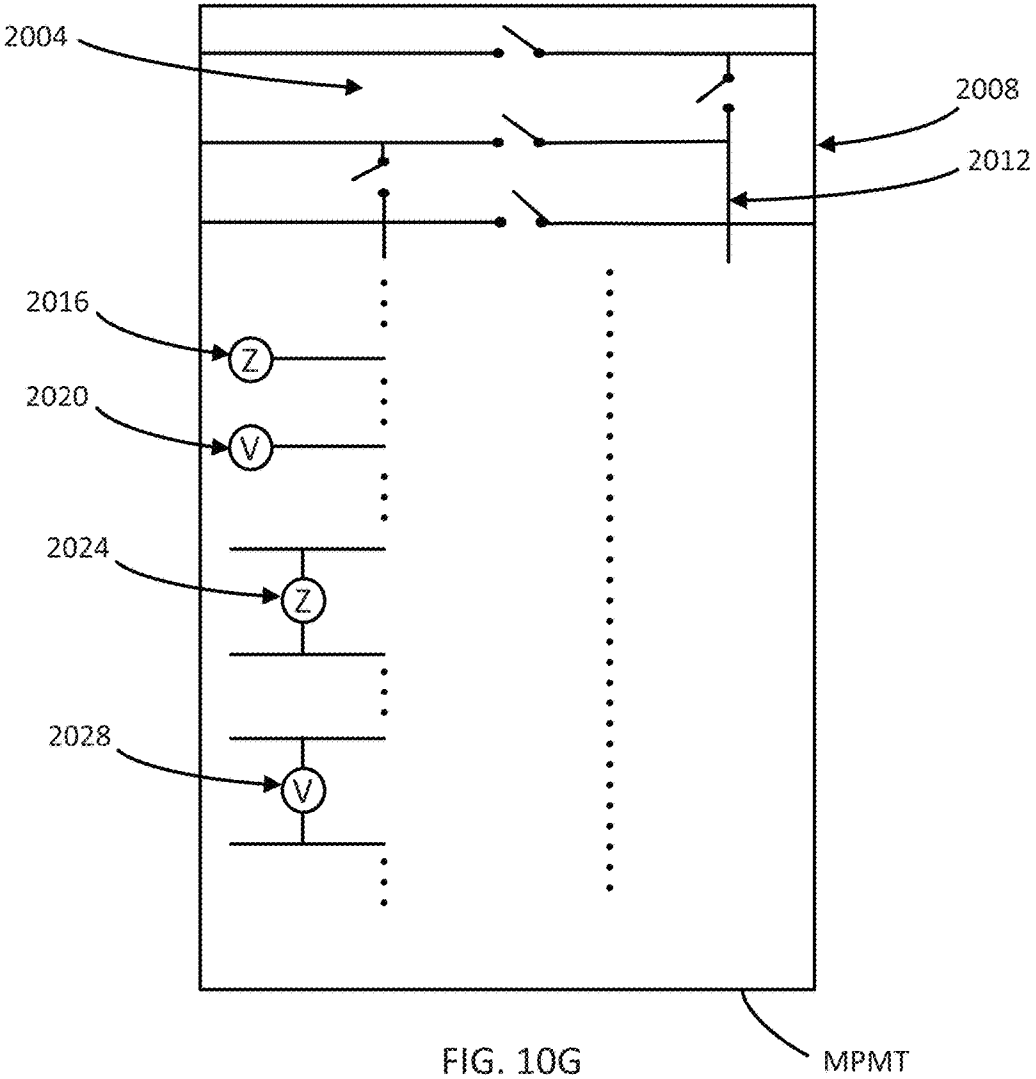
FIG. 10G illustrates examples of configuration variations inside the MPMT.

FIG. 10F illustrates an example of a configuration of SPST switches in a double-pole-double-throw (DPDT) switch. This example illustrates a symmetric case Where there are input ports 1 and 2, and output ports 1 and 2. The RF path coupling the input port 1 and the output port 2 has one SPST in series; the other RF path coupling the input port 2 and the output port 2 has one SPST in series. There are two SPST switches in shunt, one on the input side and the other on the output side. Each of the SPST switches in shunt is configured to couple the two RF paths. This DPDT switch provides six different signal paths as indicated by gray solid lines and gray dashed lines in FIG. 10F. The number of possible signal paths increases drastically as the numbers of throws and poles increase in an MPMT switch, providing vast flexibility in controlling signal paths.

FIG, 10G illustrates examples of configuration variations inside the MPMT. The number of SPSTs in shunt and the number of SPSTs in series may be equal or different; for example, a shunt SPST coupling two paths may be absent, providing an open configuration, as indicated by 2004. The number of output ports and the number of input ports may be equal (symmetric) or different (asymmetric); for example, the input (or output) side of a path may not be coupled to an input (or output) port as indicated by 2008. In another example, a shunt SPST coupling two paths may be absent, providing a short configuration, as indicated by 2012. In yet another example, a component or a module providing impedance Z, such as a capacitor, an inductor or a combination, may be coupled in series with a path as indicated by 2016. The impedance Z may be to provide 50Ω matching or other matching, or the other end of the impedance Z may be shorted, grounded, open or coupled to a pad, another component or module in the system. Similarly, a component or a module providing variable impedance V, such as a variable capacitor, a variable inductor or a combination of both, may be coupled in series with a path as indicated by 2020. The variable impedance V may be to provide variable matching, or the other end of the impedance V may be shorted, grounded, open or coupled to a pad, another component or module in the system. In yet another example, a component or a module providing impedance Z may be coupled in shunt between two paths as indicated by 2024. Similarly, a component or a module providing variable impedance V may be coupled in shunt between two paths as indicated by 2028. In each of the above examples implementing the impedance Z or the variable impedance V, one or more additional switches can be coupled to the Z or V in shunt or in series or a combination, to handle parasitics, for example. One or more of these configuration variations or combinations may be implemented in the MPMT, providing vast design flexibility depending on applications.

Figure 11:
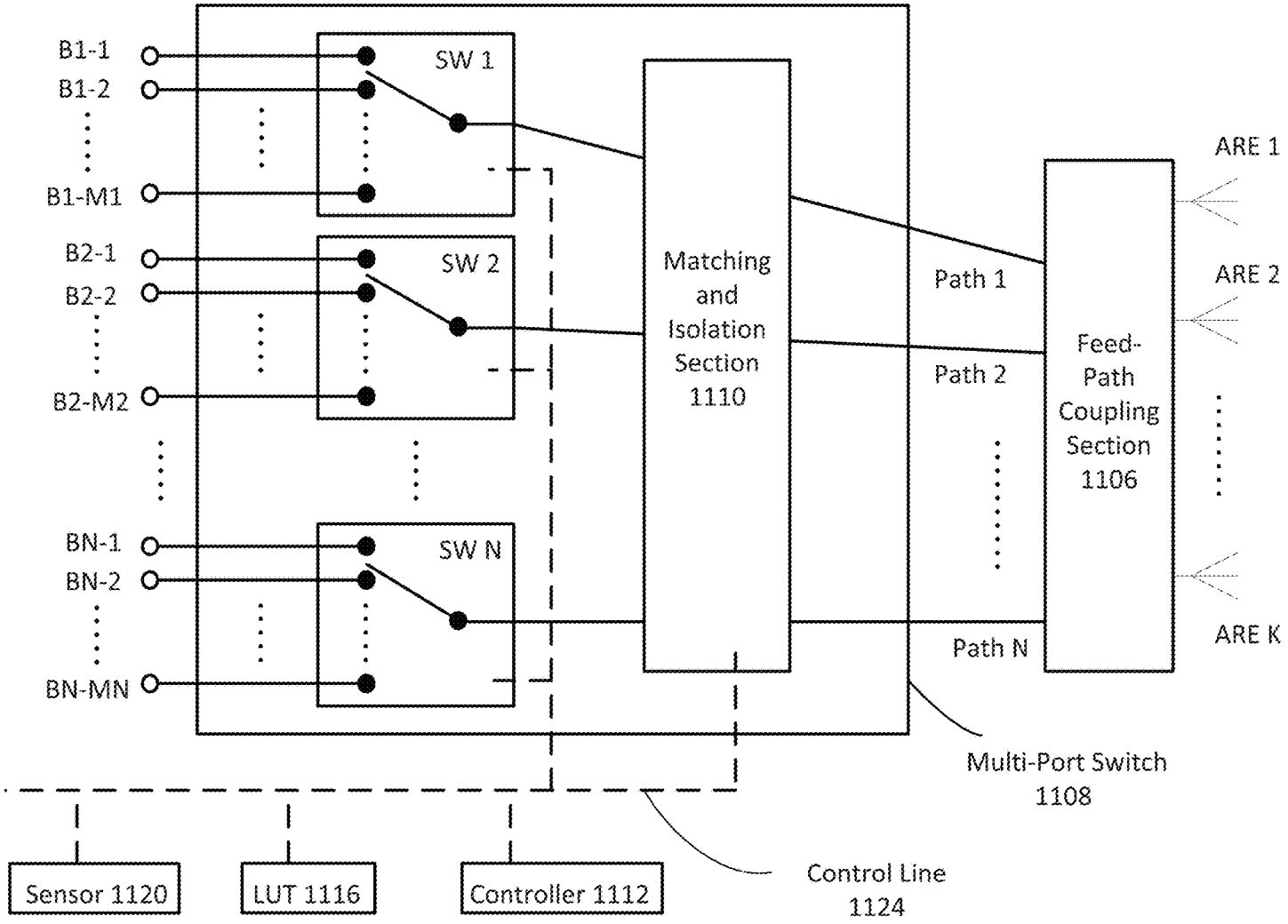
FIG. 11 illustrates an example of a configuration of a communication system, the configuration incorporating a multi-feed antenna and a matching and isolation section.

FIG. 11 illustrates an example of a configuration of a communication system, the configuration incorporating a multi-feed antenna and a matching and isolation section. In this example, a multi-feed antenna is specifically illustrated to have K-number of antenna radiating elements, labeled ARE 1, ARE 2 . . . and ARE K. Referring back to FIG. 2, isolated magnetic dipole (IMD) radiating elements 208, 212, 216 and 220 can be examples of the above antenna radiating elements, the first IMD radiating element 208 providing the first feed port 210, the second element 212 providing the second feed port 214, the third element 216 providing the third feed port 218, and the fourth element 220 providing the fourth feed port 222. The feed ports 210, 214, 218 and 222 are configured to couple to multiple paths, i.e., path 1, path 2, path 3 and path 4, respectively, corresponding to four different mode/band combinations in the communication system, thereby providing physical separation of the paths. The antenna radiating elements and the feeds may be configured to have different numbers. For example, two or more antenna radiating elements that are designed to receive or transmit signals in two more different bands, respectively, may be coupled to one feed. Therefore, the number of antenna radiating elements K may he equal to or different from the number of paths N. Additionally, one antenna radiating element coupled to one feed can be configured to receive or transmit signals in two or more different bands. In the example of FIG. 11, the multi-feed antenna having the antenna radiating elements ARE 1, ARE 2 . . . and ARE K, is configured to couple to path 1, path 2 . . . and path N through a feed-path coupling section 1106, where N is the number of feeds of the multi-feed antenna as well as the number of paths. As in the example of FIG. 4, the feed-path coupling section 1106 is configured to couple the antenna feed 1, feed 2 . . . and feed N to the path 1, path 2 . . . and path N, respectively, in a capacitive way, an inductive way, a combination of both or other suitable methods.

A multi-port switch 1108 includes a matching and isolation section 1110 and N-number of single-pole-multiple-throw switches, SW 1, SW 2 . . . and SW N. The path 1 is configured to support RF signals in a first group of bands, labeled B1-1, B1-2 . . . and B1-M1, where this first group includes M1-number of bands; the path 2 is configured to support RF signals in a second group of bands, labeled B2-1, B2-2 . . . and B2-M2, where this second group includes M2-number of bands; . . . ; and the path N is configured to support RF signals in an N-th group of hands, labeled BN-1, BN-2 . . . and BN-MN, where this N-th group includes MN-number of bands. The multi-port switch 1108 is configured to couple to multiple paths, labeled path 1, path 2 . . . and path N, from the feed-path coupling section 1106 on one side and another multiple paths on the other side to process signals respectively in multiple bands. The multi-port switch 1108 includes the multiple single-pole-multiple-throw switches, SW 1, SW 2 . . . and SW N, corresponding to the first group of bands, the second group of bands . . . and the N-th group of bands, respectively. Each of the single-pole-multiple-throw switches is used to engage one of the paths corresponding to one of the bands in the group to process the signal in the particular band.

A controller 1112, a look-up table (LUT) 1116 and a sensor 1120 are coupled to each other through a control line 1124, enabling the controller 1112 to adjust the tunable matching networks and control the on/off of the switches in the matching and isolation section 1110 based on input information. The controller 1112 is further configured to control the single-pole-multiple-throw switches, SW 1, SW 2 . . . and SW N, to engage the paths corresponding to the bands to be processed, respectively. The sensor 1120 may include one or more sensors such as a proximity sensor, a motion sensor, a light sensor, a pressure sensor or other types of sensors, to detect the use condition and/or the environment and send the detected information to the controller 1112. The controller 1112 is configured to control each of the tunable matching networks in the matching and isolation section 1110 to dynamically adjust the impedance according to the frequency band selected and the condition/environment detected during a time interval. The controller further controls the on/off of the switches in the matching and isolation section 1110 to enhance isolation for the paths. The LUT 1116 tabulates measured and/or predetermined data associated with antenna characteristics, and the controller is configured to optimize the system performance with reference to the entries in the LUT 1116 according to the selected band and time-varying conditions/environments, such as perturbations due to the placement of a head, a hand, or other interference-causing objects nearby.

Figure 12:
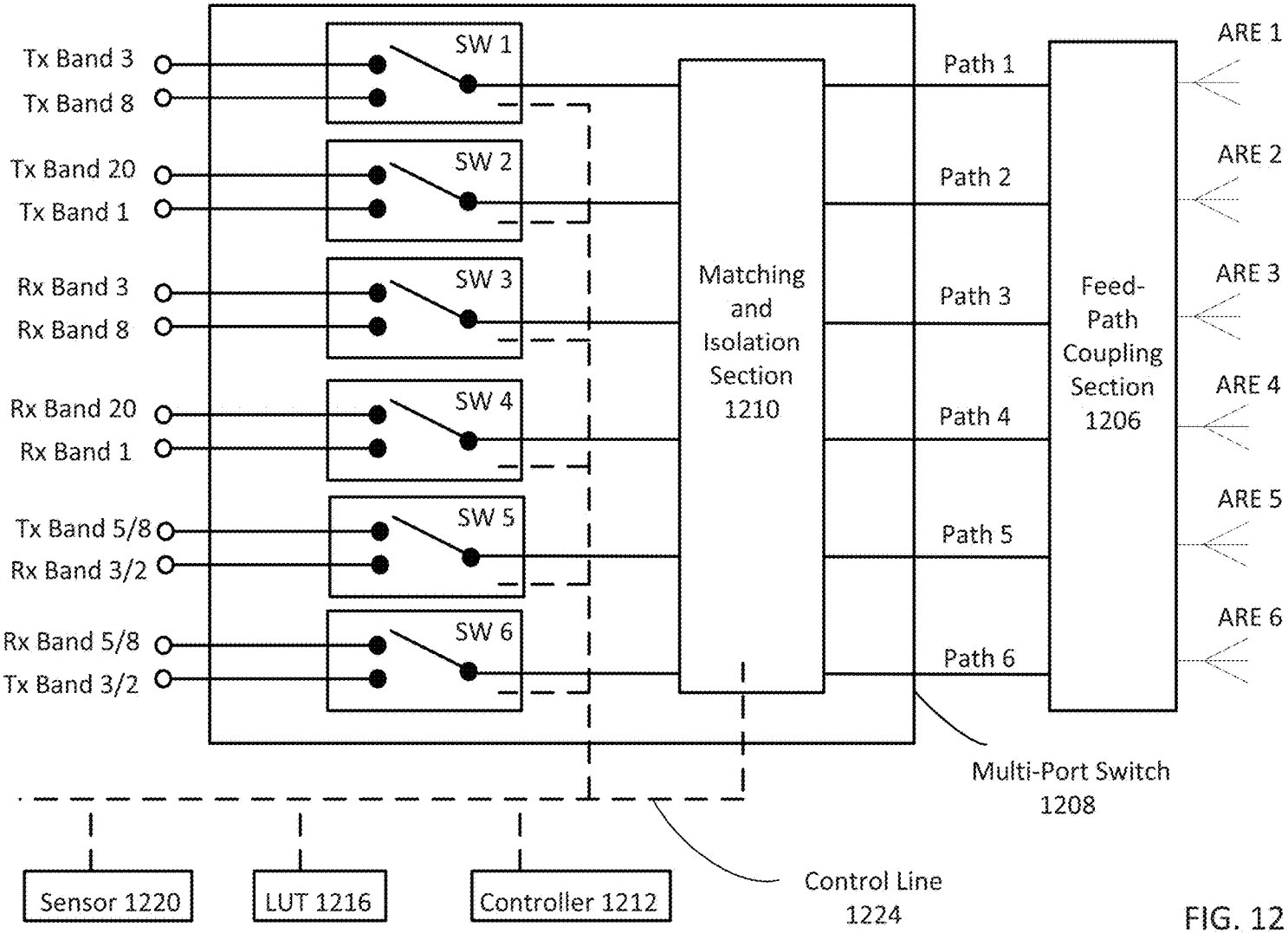
FIG. 12 illustrates a specific example of a configuration of a communication system, the configuration incorporating a multi-feed antenna and a matching and isolation section.

FIG. 12 illustrates a specific example of a configuration of a communication system, the configuration incorporating a multi-feed antenna and a matching and isolation section. FIG. 8 is a table showing the modes and frequency bands that are processed by using the communication system of FIG. 12. In this example, a multi-feed antenna is specifically illustrated to have 6 antenna radiating elements, labeled ARE 1-ARE 6. The multi-feed antenna having the antenna radiating elements, ARE 1-ARE 6, is configured to couple to path 1-path 6, through a feed-path coupling section 1206. The feed-path coupling section 1206 is configured to couple the 6 antenna feeds associated with the antenna radiating elements to the path 1-path 6, respectively, in a capacitive way, an inductive way, a combination of both or other suitable methods. The path 1 is configured to support RE signals in a first group of bands, Bands 3 and 8 for Tx. The path 2 is configured to support RE signals in a second group of bands, Bands 20 and 1 for Tx. The path 3 is configured to support RF signals in a third group of bands, Bands 3 and 8 for Rx. The path 4 is configured to support RF signals in a fourth group of bands, Bands 20 and 1 for Rx. The path 5 is configured to support RE signals in a fifth group of bands, Bands 5 and 8 for Tx and Bands 3 and 2 for Rx. The path 6 is configured to support RF signals in a sixth group of bands, Bands 5 and 8 for Rx and Bands 3 and 2 for Tx. Thus, a multi-port switch 1208 is configured to couple to the 6 paths on one side and 12 paths on the other side to process signals respectively in the multiple bands, thereby forming a hexa-pole-12-throw (HP12T) switch. The multi-port switch 1208 includes 6 single-pole-double-throw (SPDT) switches, labeled SW 1-SW 6, corresponding to the first group through the sixth group of bands, respectively. Each of the SPDT switches is used to engage one of the paths corresponding to one of the bands in the group to process the signal in the particular band. In this example, the path 1 is split into two paths, labeled Tx Band 3 and Tx Band 8, supporting the Tx signals in Bands 3 and 8, respectively. The switch SW 1 is used to engage one of the two paths corresponding to the selected frequency band of the signal. The path 2 is split into two paths, labeled Tx Band 20 and Tx Band 8, supporting the Tx signals in Bands 20 and 1, respectively. The switch SW 2 is used to engage one of the two paths corresponding to the selected frequency band of the signal. The path 3 is split into two paths, labeled Rx Band 3 and Rx Band 8, supporting the Rx signals in Bands 3 and 8, respectively. The switch SW 3 is used to engage one of the two paths corresponding to the selected frequency band of the signal. The path 4 is split into two paths, labeled Rx Band 20 and Rx Band 1, supporting the Rx signals in Bands 20 and 1, respectively. The switch SW 4 is used to engage one of the two paths corresponding to the selected frequency band of the signal. The path 5 is split into two paths, labeled Tx Band 5/8 and Rx Band 3/2, supporting the Tx signals in Bands 5 and 8 and the Rx signals in Bands 3 and 2, respectively. The switch SW 5 is used to engage one of the two paths corresponding to the selected frequency band of the signal. The path 6 is split into two paths, labeled Rx Band 5/8 and Tx Band 3/2, supporting the Rx signals in Bands 5 and 8 and the Tx signals in Bands 3 and 2, respectively. The switch SW 6 is used to engage one of the two paths corresponding to the selected frequency band of the signal. The multi-port switch 1208 further includes a matching and isolation section 1210 coupled to the paths 1 through 6. The matching and isolation section 1210 includes tunable matching networks coupled to switches, as illustrated in FIGS. 10-10D, for example, to enhance isolation.

A controller 1212, a look-up table (LUT) 1216 and a sensor 1220 are coupled to each other through a control line 1224, enabling the controller 1212 to adjust the tunable matching networks and control the on/off of the switches in the matching and isolation section 1210 based on input information. The controller 1212 may he further configured to control the SPDT switches, SW 1-SW 6, to engage the paths corresponding to the bands to be processed, respectively. The sensor 1220 may include one or more sensors such as a proximity sensor, a motion sensor, a light sensor, a pressure sensor or other types of sensors, to detect the use condition and/or the environment and send the detected information to the controller 1212. The controller 1212 is configured to control each of the tunable matching networks in the matching and isolation section 1210 to dynamically adjust the impedance according to the frequency band selected and the condition/environment detected during a time interval. The controller further controls the on/off of the switches in the matching and isolation section 1210 to enhance isolation for the paths. The LUT 1216 tabulates measured and/or predetermined data associated with antenna characteristics, and the controller is configured to optimize the system performance with reference to the entries in the LUT 1216 according to the selected band and time-varying conditions/environments, such as perturbations due to the placement of a head, a hand, or other interference-causing objects nearby.

The multi-port switch, such as illustrated in FIG. 4, 7, 9, 11 or 12, can be integrated on a silicon chip, providing a compact real estate with operational characteristics of a high speed semiconductor device. For example, a silicon-on-insulator (SOI) CMOS technology may be used, wherein low-loss transistor switches and relatively high-quality monolithic inductors are achievable in the process. Alternatively, GaAs- or InP-based fabrication technologies may be utilized depending on the design parameters and target quality and/or cost indices.

As described with reference to FIGS. 10-12, the switches may be included in the matching and isolation section to enhance isolation for the multi-feed antennas system. The similar isolation scheme based on the switches in the matching and isolation section can be adapted for a multiple antenna system, an example of which is illustrated in FIG. 9. In this example, one or more of the antennas and even all of the antennas may be configured to be multi-feed antennas, or all of the antennas may be configured to be single-feed antennas. The system includes multiple paths, each supporting RF signals in a group of frequency bands. One or more tunable matching networks may be coupled to the multiple paths to provide proper matching. Additionally, one or more switches may be included for each path, and the controller can be further configured to control the switches to enhance isolation for the multiple antenna system as in the case of a multi-feed antenna system described earlier.

Referring back to FIGS. 6A-6D, examples of configuration variations of the tunable matching networks coupled with the multiple RF paths are illustrated. To enhance the isolation, switches may be added to the configuration of the tunable matching networks to form the matching and isolation section 1008, as exemplified in FIGS. 10 and 10A-10D. In these examples, a single tunable matching network is used for matching involving one or more RF paths. However, it is possible to use a block of two or more tunable matching networks in place of a single tunable matching network. Furthermore, one or more of the switches in the matching and isolation section 1008 may be included in the block. These tunable matching networks and the switches in a block can be integrated on a chip, providing a pick-and-place solution for matching and isolation purposes for a multi-band system. Additional components, such as capacitors and/or inductors, can be added externally to the chip for design adjustments. The resultant tunable matching block, including two or more tunable matching networks and optional switches and circuits for design adjustment can provide flexibility in high-level matching, isolation, frequency tuning, filtering out second and higher harmonics, and various other performance enhancements.

Figure 13:
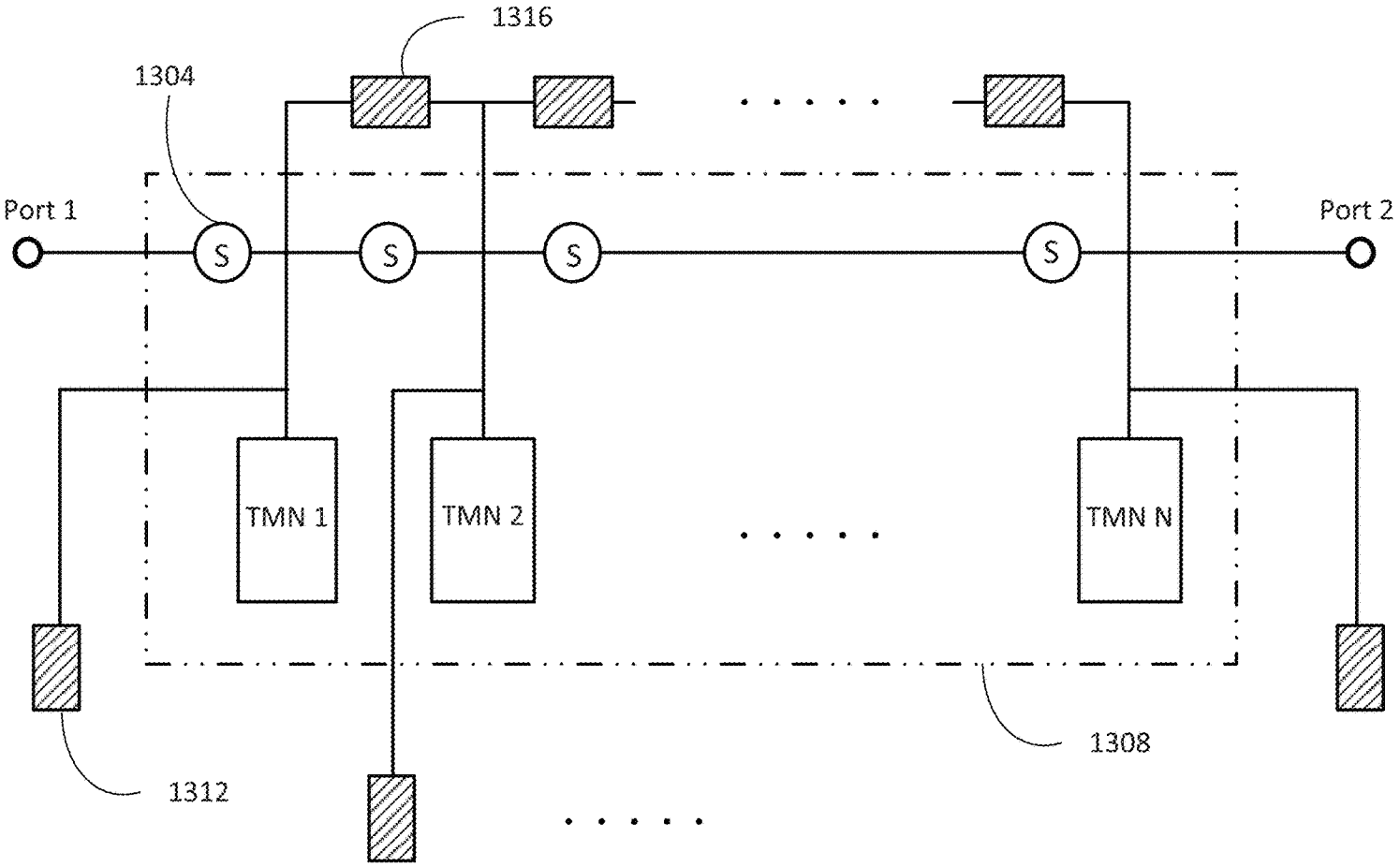
FIG. 13 illustrates an example of a tunable matching block including two or more tunable matching networks.

FIG. 13 illustrates an example of a tunable matching block including two or more tunable matching networks, labeled TMN1, TMN2 . . . and TMN N. In this example, one end of each of the tunable matching networks is coupled in shunt to the path having two ports, Port 1 and Port 2. These two ports may be configured to be coupled to a same RF path or to two different RF paths in the system. The other end of each tunable matching network may be coupled to another circuit, module or component in the system, shorted to ground or kept open, as mentioned earlier in this document. Although a shunt configuration is illustrated in this example, the multiple tunable matching networks may be configured to be coupled in series. Alternatively, some of the tunable matching networks may be configured to be coupled in shunt and the others in series. The tunable matching block may further include one or more switches, possible locations of which are indicated by circles with "S" in the figure, such as a location 1304. If no switch is used at any one of the possible locations, a transmission line is used for that location. These multiple tunable matching networks and the switches can be integrated on a chip 1308 or remain discrete. The tunable matching block may further include one or more adjustment circuits, possible locations of which are indicated by hashed boxes in the figures, such as locations 1312 and 1316. If no adjustment circuit is used at any one of the possible locations, that location is open. Each adjustment circuit may include one or more inductors and/or one or more capacitors. In the example of FIG. 13, the adjustment circuit is configured to be coupled in shunt with one tunable matching network, such as the adjustment circuit at the location 1312, or in series with two adjacent tunable matching networks, such as the adjustment circuit at the location 1316.

Figure 14A:
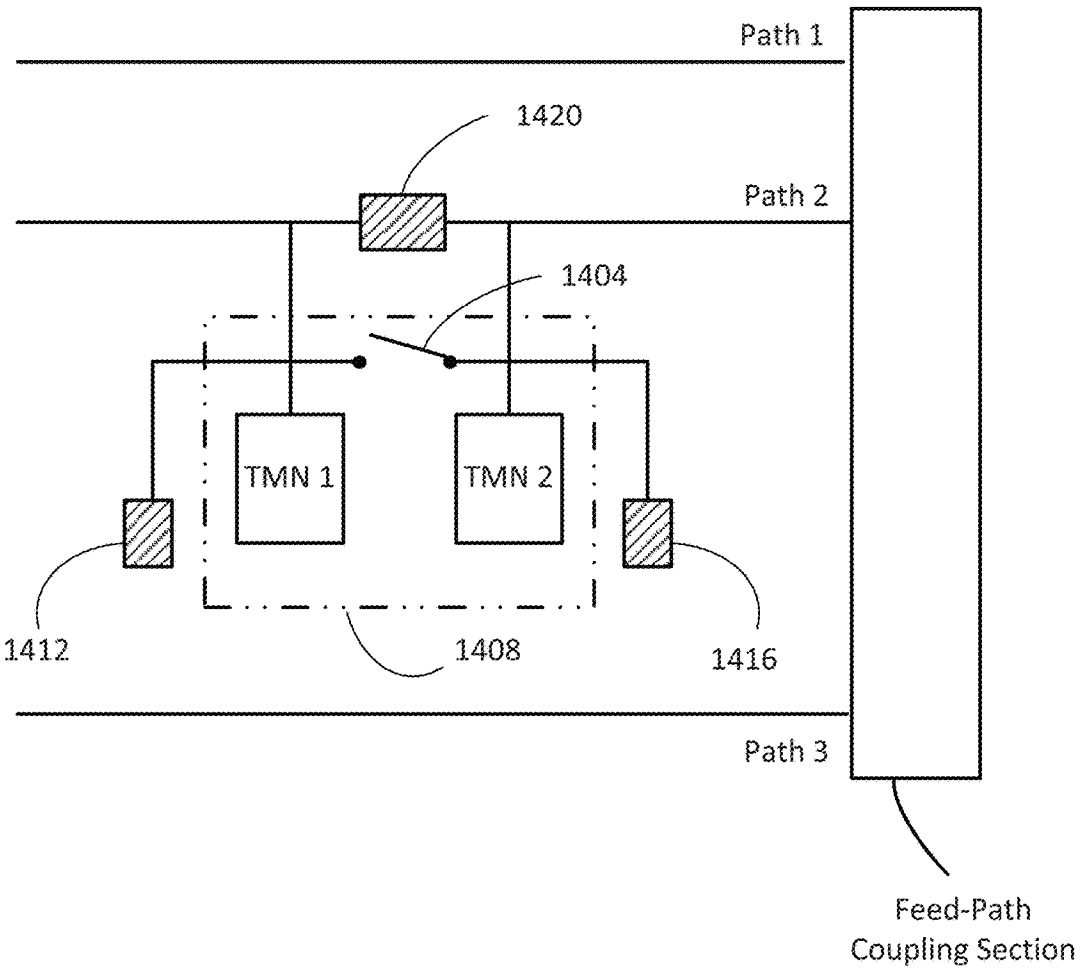
FIG. 14A illustrates a specific example of a tunable matching block coupled to one path, of a multi-band system having three paths.

FIG. 14A illustrates a specific example of a tunable matching block coupled to one RF path, Path 2, of a multi-band system having three paths, Path 1, Path 2 and Path 3, stemming from the feed-path coupling section. Specifically, both Port 1 and Port 2 of the tunable matching block are coupled to Path 2. This tunable matching block includes two tunable matching networks, TMN 1 and TMN 2, coupled in shunt. A switch 1404 is included in series between TMN 1 and TMN 2. These tunable matching networks, TMN 1 and TMN2, and the switch 1404 may be integrated on a chip 1408, or remain discrete. This tunable matching block further includes adjustment circuits 1412, 1416 and 1420. The adjustment circuits 1412 and 1416 are coupled in shunt with TMN 1 and TMN 2, respectively. The adjustment circuit 1420 is coupled in series between TMN 1 and TMN 2, hence with Path 2, This tunable matching block is an example configured to provide high-level matching, tuning and other performance enhancements for one path in the multi-band system.

Figure 14B:
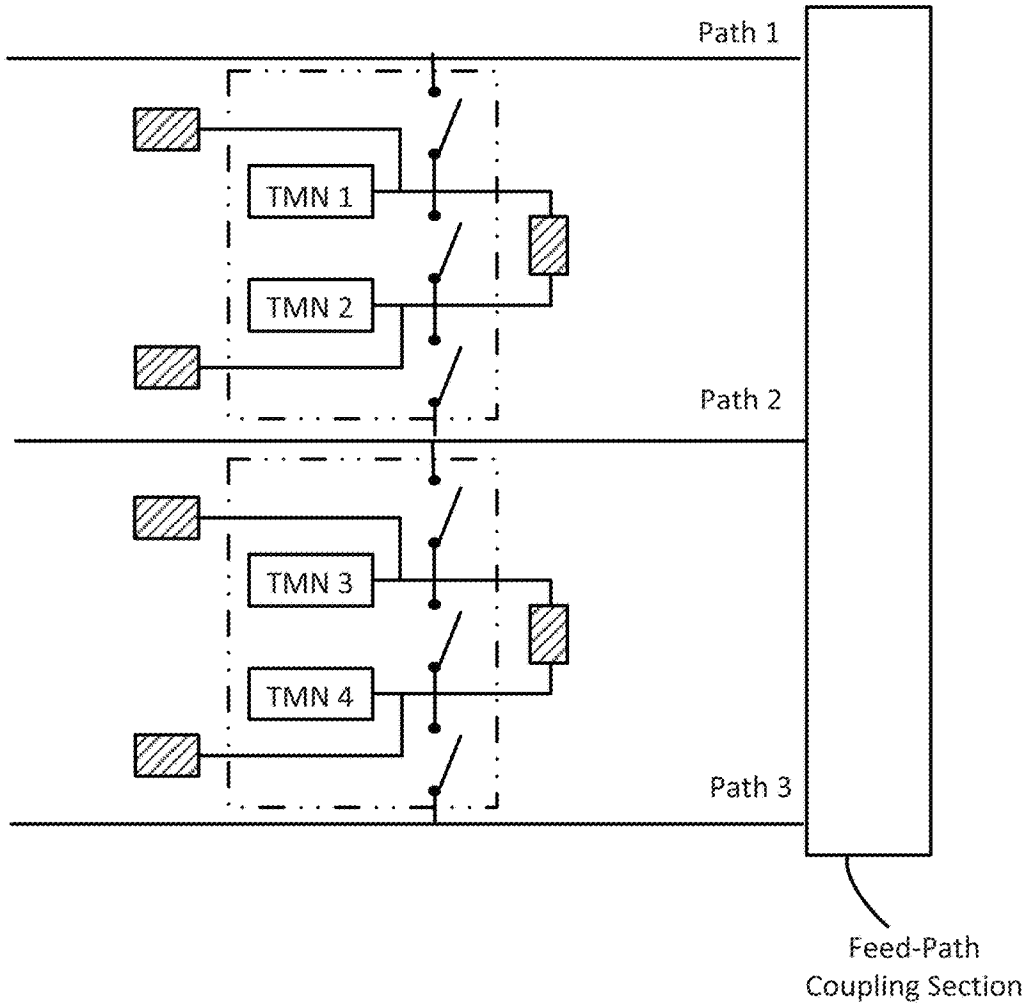
FIG. 14B illustrates a specific example of two tunable matching blocks, each coupled to two paths of a multi-band system having three paths.

FIG. 14B illustrates a specific example of two tunable matching blocks, each coupled to two RF paths of a multi-band system having three paths, Path 1, Path 2 and Path 3, stemming from the feed-path coupling section. These two tunable matching blocks are identical in configuration in this example. Each tunable matching block includes two tunable matching networks coupled in shunt, TMN 1 and TMN 2 in one of them and TMN 3 and TMN 4 in the other, three switches and three adjustment circuits. Each switch is controlled by a controller to provide proper isolation. The two tunable matching networks and the three switches in one tunable matching block may be integrated on a chip or remain discrete. The configuration of these two tunable matching blocks is an example that can provide high-level matching, tuning and other performance enhancements for three paths simultaneously in the multi-band system, in FIGS. 14A and 14B above, the multi-band system with three paths is used as an example. The tunable matching block as illustrated in FIG. 13 can be implemented in a system having N-number of paths as illustrated in FIG. 11, where N>1. One tunable matching block is coupled to one path in the example of FIG. 14A; two or more tunable matching blocks can be coupled to two or more paths, respectively. Two tunable matching blocks are coupled to three paths in the example of FIG. 14B, each block being coupled to two paths; three or more tunable matching blocks can be coupled to multiple paths, each block being coupled to two or more paths. Alternatively, a combination of a tunable matching block coupled to one path and a tunable matching block coupled to two or more paths can be implemented in the system.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A communication system comprising:

one or more antennas comprising a plurality of feeds coupled to a plurality of paths, respectively, each path configured to process signals in a group of frequency bands;

one or more matching blocks, each matching block comprising a plurality of matching networks and coupled to one or more of the plurality of paths;

one or more adjustment circuits, each of the one or more adjustment circuits being coupled to at least one of the plurality of matching networks;

a look-up table including characterization data according to frequency bands and conditions; and a controller configured to control the plurality of matching networks in each matching block by referring to the look-up table to provide impedance for a frequency band selected and under a condition detected during a time interval;

wherein each matching block further comprises one or more switches, wherein a first switch of the one or more switches is disposed in shunt between a first matching network and a second matching network of the plurality of matching networks.

2. The communication system of claim 1, wherein the plurality of matching networks and the one or more switches are integrated on a chip.

3. The communication system of claim 1, wherein each adjustment circuit comprises one or more capacitors, one or more inductors, or a combination of both.

4. The communication system of claim 3, wherein a first adjustment circuit of the one or more adjustment circuits is coupled, in shunt, to a first matching network of the plurality of matching networks.

5. The communication system of claim 4, wherein a second adjustment circuit of the one or more adjustment circuits is coupled, in shunt, to a second matching network of the plurality of matching networks.

6. The communication system of claim 3, wherein a first adjustment circuit of the one or more adjustment circuits is coupled, in series, to each of a first matching network and a second matching network of the plurality of matching networks.

7. A communication system comprising:

one or more antennas comprising a plurality of feeds coupled to a plurality of paths, respectively, each path configured to process signals in a group of frequency bands;

one or more matching blocks, each matching block comprising a plurality of matching networks and coupled to one or more of the plurality of paths;

one or more adjustment circuits, each of the one or more adjustment circuits being coupled to at least one of the plurality of matching networks;

a look-up table including characterization data according to frequency bands and conditions; and a controller configured to control the plurality of matching networks in each matching block by referring to the look-up table to provide impedance for a frequency band selected and under a condition detected during a time interval;

wherein each matching block further comprises one or more switches;

wherein each adjustment circuit comprises one or more capacitors, one or more inductors, or a combination of both;

wherein a first adjustment circuit of the one or more adjustment circuits is coupled, in shunt, to a first matching network of the plurality of matching networks.

8. The communication system of claim 7, wherein a second adjustment circuit of the one or more adjustment circuits is coupled, in shunt, to a second matching network of the plurality of matching networks.

9. A communication system comprising:

one or more antennas comprising a plurality of feeds coupled to a plurality of paths, respectively, each path configured to process signals in a group of frequency bands;

one or more matching blocks, each matching block comprising a plurality of matching networks and coupled to one or more of the plurality of paths;

one or more adjustment circuits, each of the one or more adjustment circuits being coupled to at least one of the plurality of matching networks;

a look-up table including characterization data according to frequency bands and conditions; and a controller configured to control the plurality of matching networks in each matching block by referring to the look-up table to provide impedance for a frequency band selected and under a condition detected during a time interval;

wherein each matching block further comprises one or more switches;

wherein each adjustment circuit comprises one or more capacitors, one or more inductors, or a combination of both;

wherein a first adjustment circuit of the one or more adjustment circuits is coupled, in series, to each of a first matching network and a second matching network of the plurality of matching networks.

* * * * *